US005246325A

United States Patent [19]

Morishige et al.

[11] Patent Number: 5,246,325

[45] Date of Patent: Sep. 21, 1993

[54] SHEET MATERIAL BINDING APPARATUS

[75] Inventors: Yuji Morishige, Yokohama; Shinichi Nakamura; Hisatsugu Tahara, both of Kawasaki; Tomobumi Nakayama; Satoshi Kuroyanagi, both of Tokyo; Osamu Iwamoto; Norifumi Miyake, both of Kawasaki; Hideaki Furukawa, Yokohama, all of Japan

[73] Assignee: Canon Kabushiki Kaisha, Tokyo, Japan

[21] Appl. No.: 892,734

[22] Filed: Jun. 1, 1992

Related U.S. Application Data

[63] Continuation of Ser. No. 523,562, May 15, 1990, abandoned.

[30] Foreign Application Priority Data

May 18, 1989 [JP] Japan ..... 1-122881
May 18, 1989 [JP] Japan ..... 1-122882
Aug. 31, 1989 [JP] Japan ..... 1-226908

[51] Int. Cl.[5] ..... B42C 13/00

[52] U.S. Cl. ..... 412/11; 412/8; 412/13; 412/14; 412/37; 412/900; 156/359; 156/378

[58] Field of Search ..... 412/33, 37, 902, 11, 412/13, 14, 900; 156/350, 359, 362, 363, 364, 366, 367, 368, 378, 297, 908

[56] References Cited

U.S. PATENT DOCUMENTS 4,009,498 3/1977 Staats et al. ..... 412/37
4,311,549 1/1982 Vercillo ..... 156/368 X
4,818,168 4/1989 Battisti ..... 412/37
4,863,332 9/1989 Wiholm et al. ..... 412/37

*Primary Examiner*—Irene Cuda
*Assistant Examiner*—S. Thomas Hughes
*Attorney, Agent, or Firm*—Fitzpatrick, Cella, Harper & Scinto

[57] ABSTRACT

A binding apparatus for binding sheet materials with a covering material having a heat-adhesive agent at its bottom portion by bonding the bottom portion of the covering member and edges of the sheet materials includes a holder for holding the covering material and the sheet materials sandwiched by the covering material; a heater for heating the adhesive agent; a switch for switching power supply to the heater; a detector for detecting setting of the covering material in the holder; and a temperature controller. The temperature controller supplies power to provide a first temperature when the covering material is not set in the holder, supplies power to the heater to provide a second temperature higher than the first temperature when the covering material is set in the supporting member, and supplies the power to the heater to provide the first temperature after the covering member is taken out from the holding member.

17 Claims, 22 Drawing Sheets

SHEET MATERIAL BINDING APPARATUS

This application is a continuation of application of application Ser. No. 523,562 filed May 15, 1990, now abandoned.

FIELD OF THE INVENTION AND RELATED ART

The present invention relates to a sheet binder for binding sheet materials such as original documents or the like, and more particularly to a binding apparatus for binding back edges of the sheet materials and a bottom (spine) of a covering material with an adhesive agent.

In a binding apparatus wherein the back edges of the sheets and the bottom of the covering material are bound by melting and solidifying the adhesive agent, the setting temperature of the heating means for melting the adhesive has been made to a single level from the start of the binding operation, and the heating is stopped after a predetermined period of heating time, by which the heat is irradiated.

In another conventional apparatus, the heater is kept energized after the main switch is actuated, irrespective of whether or not the binding operation is performed. That is, the heater is energized even when the binding operation is interrupted.

However, in the structure wherein the heating operation is started at the start of the binding operation, and the heating is stopped after the predetermined period of time, the heating means at the normal temperature is heated from the start of the binding operation to the adhesive melting temperature, so that the pre-heating period is included in the operating time. In this process, the overall binding operation takes a longer time.

In the structure wherein the temperature of the heating member is maintained at a constant level after the main switch is actuated, irrespective of the binding operation, the constant temperature has to be so selected that it is high enough for melting the adhesive, 100° C., for example. By doing so, the time required for the binding operation becomes short. However, when the binding operation is not performed, the apparatus is kept at the quite high temperature with the result that the constituent parts of the apparatus are kept at the high temperature, and therefore, that the service life and the performance of the apparatus are deteriorated.

SUMMARY OF THE INVENTION

Accordingly, it is a principal object of the present invention to provide a binding apparatus wherein the heating means can be maintained selectively at two or more levels of the temperature including the pre-heating temperature and the heating temperature, by which the safety of the apparatus and the power consumption thereof are improved.

According to an aspect of the present invention, the heating means is operated in the pre-heating mode even after the main switch is actuated, unless the covering material is set. Thereafter, in response to the detection that the covering material is set, it is operated in the heating mode (high temperature). If the covering material is removed thereafter, the heating means is operated again in the pre-heating mode.

According to the feature of this aspect of the invention, the heating portion including the heating means is prevented from being rapidly heated, as contrasted to the case in which the heating means is always maintained at the operable temperature or to the case in which the heating means is heated to the operable temperature only at the binding operation. Therefore, the safety of the apparatus can be significantly improved. In addition, the electric power consumption can be reduced as compared with the case wherein the heating means is always maintained at the operable temperature. Furthermore, the binding efficiency is improved over the case wherein the heating means is heated to the operable (binding) temperature only upon the binding operation.

The power consumption can be significantly reduced by switching the heating means from a second temperature to a first temperature after a predetermined period of time elapses from setting the sheets sandwiched by the covering member in the apparatus.

After the main switches are actuated, the heating means is heated to the first temperature. However, if the covering material is not set in the apparatus even after a predetermined period of time elapses, a controller stops the temperature control, so that the heating means is not energized, by which the power consumption is significantly reduced.

If the covering material is not set in the apparatus even after a predetermined period elapses during the first temperature maintained, the temperature control is stopped, so that the heating of the heating means is interrupted. However, the covering material is set thereafter, the heating means is operated, and the temperature control is resumed. By doing so, the operator is not required to reset the power source.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The first embodiment of the present invention will be described in conjunction with FIGS. 1-8.

Figure 1:
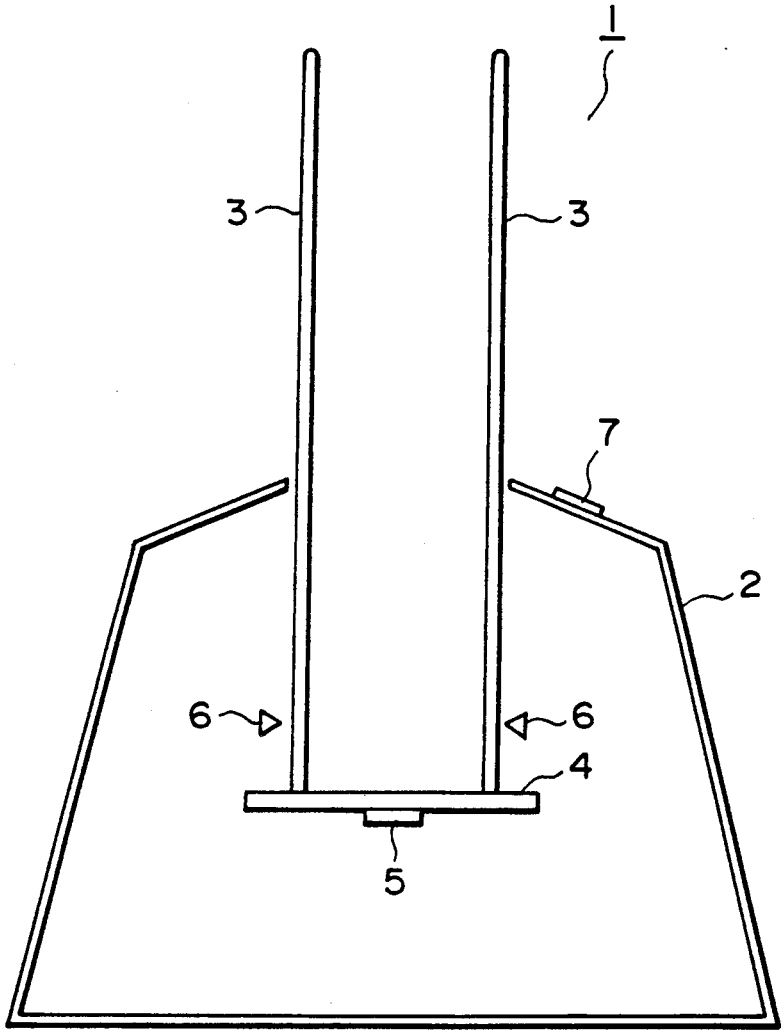
FIG. 1 is a general view in cross-section of a binding apparatus according to a first embodiment of the present invention.

Referring first to FIG. 1, a binding apparatus 1 has a base 2 having a generally trapezoidal shape. A pair of holding members 3 are extended through the top of the base 2. The interval between the holding members 3 is adjustable. At the bottom of the holding members 3, a heater 4 is mounted extending horizontally. To the backside of the heater 4, a thermister 5 is mounted to detect the temperature of the heater 4 in accordance with the electric resistance thereof. Adjacent the bottom of the holding members 3, corresponding holes are formed, and transparent type sensor elements 6 are set in the holes. At the shoulder of the base 3, there is a display light 7 made of LED (light emitting diode) elements to display the actuation of the main switch or the like.

Figure 2A:
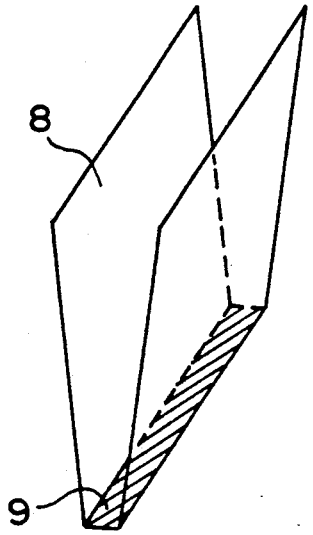
FIG. 2A is a perspective view of an example of a covering material with an adhesive agent.

As shown in FIG. 2A, a covering material 8 has a solid adhesive agent 9 at its bottom. The adhesive agent 9 is melted at a high temperature, but is not melted at a temperature lower than 70° C.

Figure 2B:
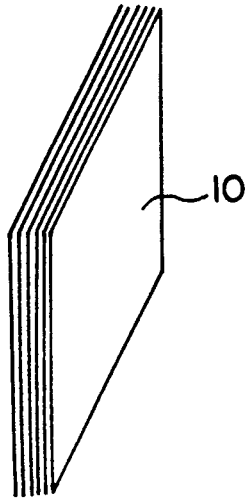
FIG. 2B is a perspective view of a set of sheets.
Figure 2C:
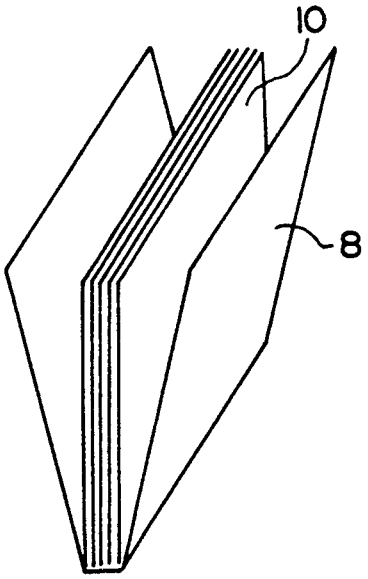
FIG. 2C is a perspective view of the set of sheets sandwiched by the covering material.

As shown in FIG. 2B, a set of sheets 10 is set between the front cover and the back cover of the covering material 8, as shown in FIG. 2C. The covering material 8 with the sheets sandwiched by the covering material 8 is set into between the holding members 3 to bind them.

Figure 3:
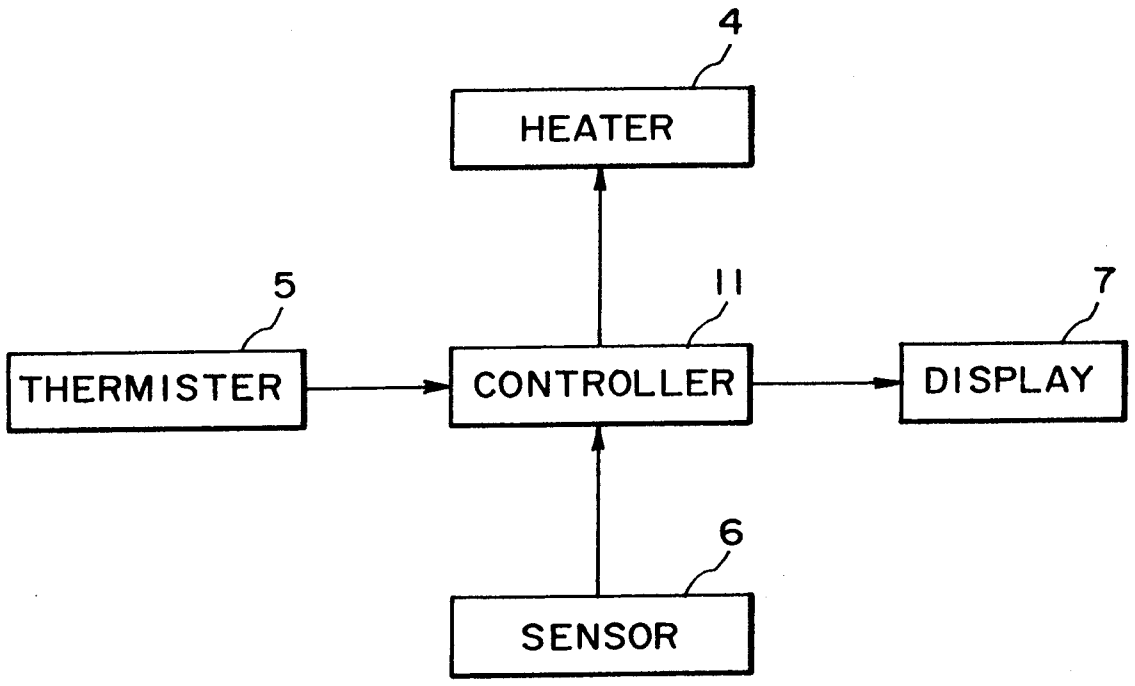
FIG. 3 is a block diagram of control means.

FIG. 3 is a block diagram of the control system for the apparatus of this embodiment.

When the sensor (detecting means) 6 detects that the covering material 8 sandwiching the sheets 10 is set between the holding members 3, it produces a detection signal and supplies it to the controller (control means) 11.

The thermister (temperature detecting means) 5 detects the temperature of the heater (heating means) 4, and it supplies the temperature signal to the controller 11. The controller 11, in response to the temperature signal, energizes and deenergizes to maintain the temperature of the heater 4 at a predetermined temperature level.

The controller 11 instructs the display light 7 to display the on-state of the power switch.

Figure 4:
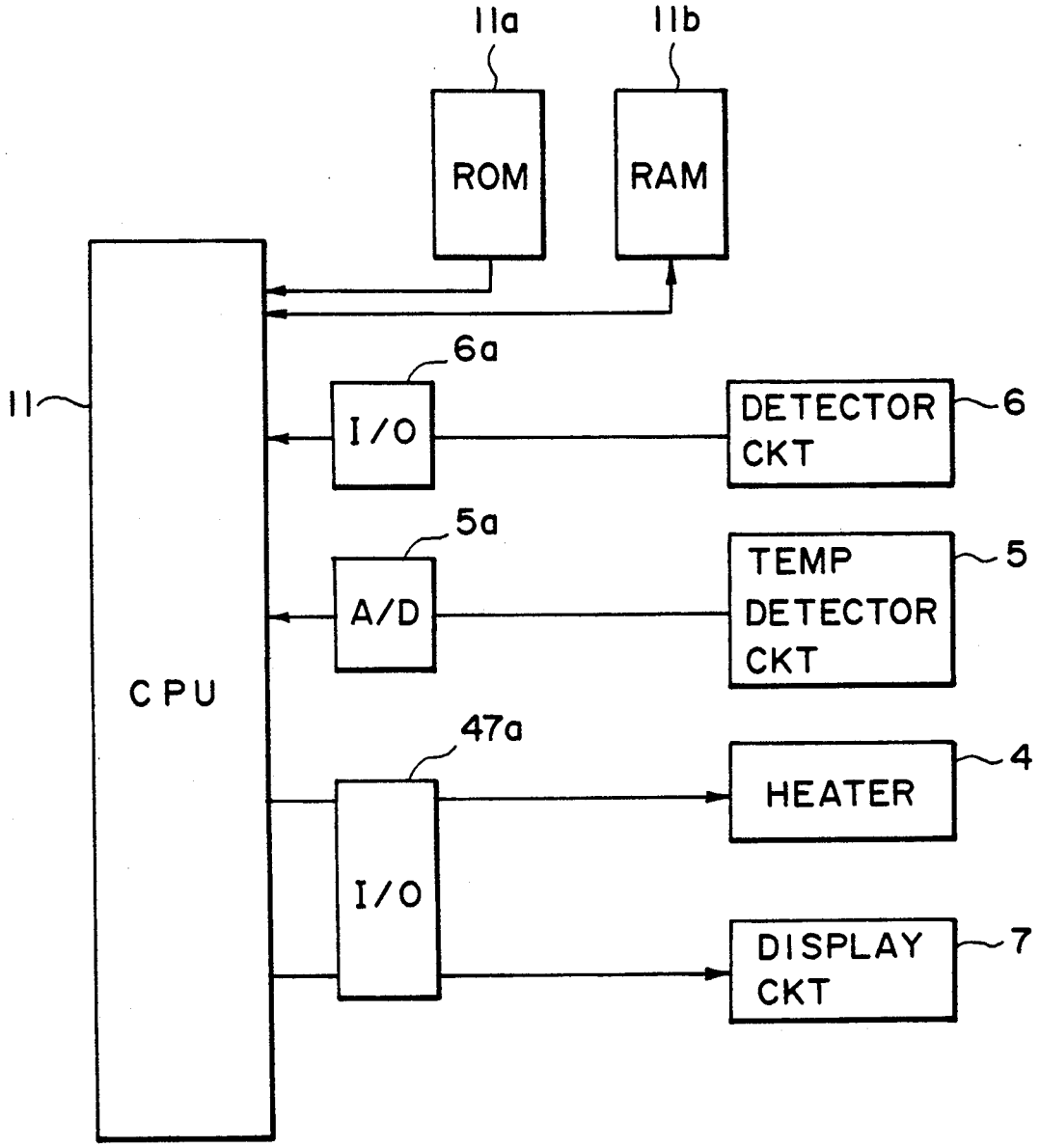
FIG. 4 is a block diagram illustrating the circuit structure of the control means.

FIG. 4 is a block diagram of the structure of the circuit for the above control. A central processing unit (CPU) (controller) 11 is connected with a detection circuit 6 through an input port 6*a*, a temperature detecting circuit (thermister) 5 through an A/D transducer input port 5*a*, the heater 4 and the display circuit 7 through an output port 47*a*. The CPU 11 controls the heater 4 and the display circuit 7 in accordance with a control program stored in ROM 11*a* in response to the data supplied from the detecting circuit 6 and the temperature detecting circuit 5 RAM 11*b* functions to store the input data and operation data.

Referring to FIGS. 5-8, the operation of the apparatus of this embodiment will be described.

Figure 5:
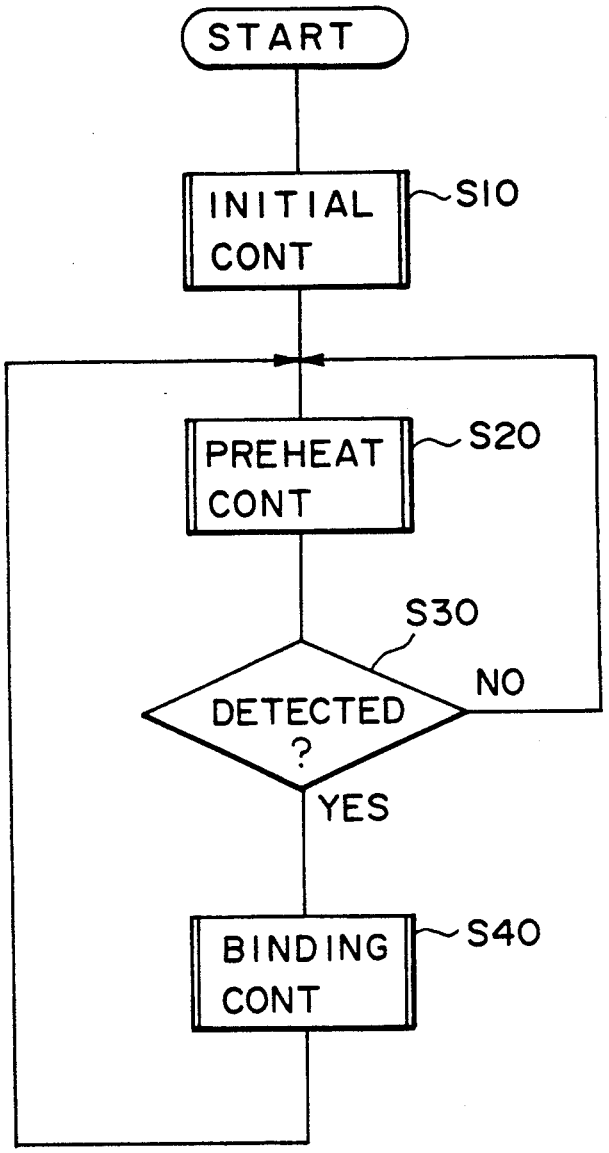
FIG. 5 is a general flow chart illustrating the operation.

FIG. 5 is a general flow chart. When the main switch is actuated, the predetermined initial setting operations (initial control) are performed (S10). Thereafter, a pre-heating control is effected (S20) until the covering material 8 sandwiching the sheets 10 is detected by the sensor 6. At step S30, if the sensor 6 produces a signal, step S40 is executed to perform and finish the binding operation. When the detection signal is not produced from the sensor 6 during or after the binding operation (S40), the step S20 is performed to repeat the above control operations.

It is preferable that the temperature maintained by the pre-heating control (S20) is not higher than 70° C. so that the operator is not damaged even if the operator contacts the apparatus, and so that the binding agent is not melted. The inventors' repeated experiments and investigations have revealed that the optimum temperature maintained by the pre-heating operation is approximately 60° C.

It may be a temperature higher than 60° C., but it should not be higher than 70° C.

Figure 6:
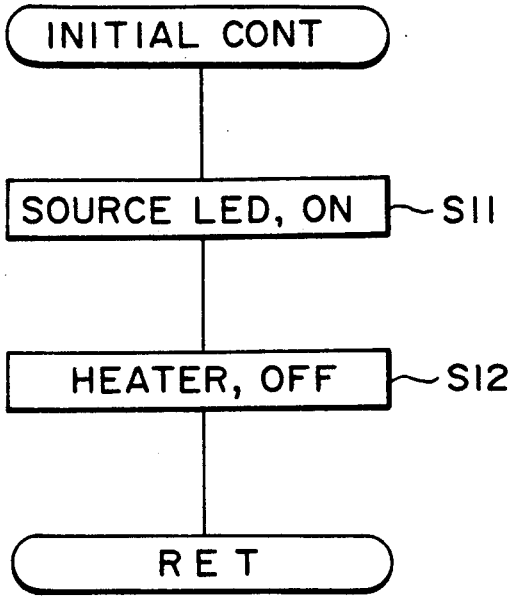
FIG. 6 is a flow chart for an initial control.

FIG. 6 illustrates the initial control at the step S10. After the main switch is actuated (LED is rendered on) (S11), the heater 4 is deenergized.

Figure 7:
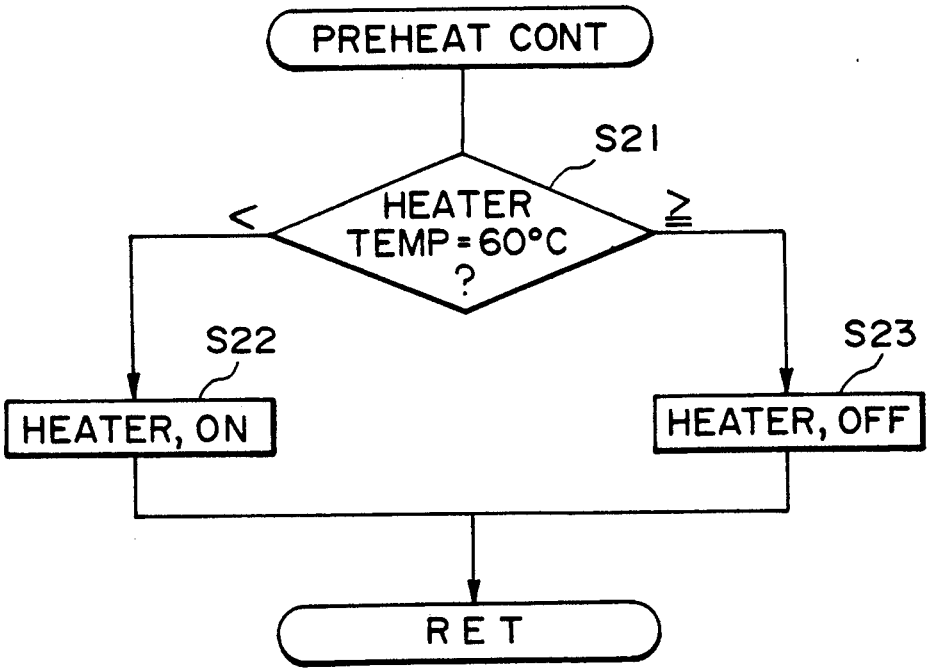
FIG. 7 is a flow chart of a pre-heating control.

FIG. 7 illustrates the pre-heating control (S20). It is performed as a preparation for the binding operation. The pre-heating temperature is set to 60° C. in this embodiment (S21). When the temperature of the heater 4 detected by the thermister 5 is lower than 60° C., the heater 4 is energized (S22), and when the temperature is equal to or higher than 60° C., the heater 4 is deenergized (S24).

In this manner, when the sensor 6 does not produce the detection signal at the step S30, the pre-heating control is continuously performed, by which the temperature of the heater 4 is maintained at 60° C.

Figure 8:
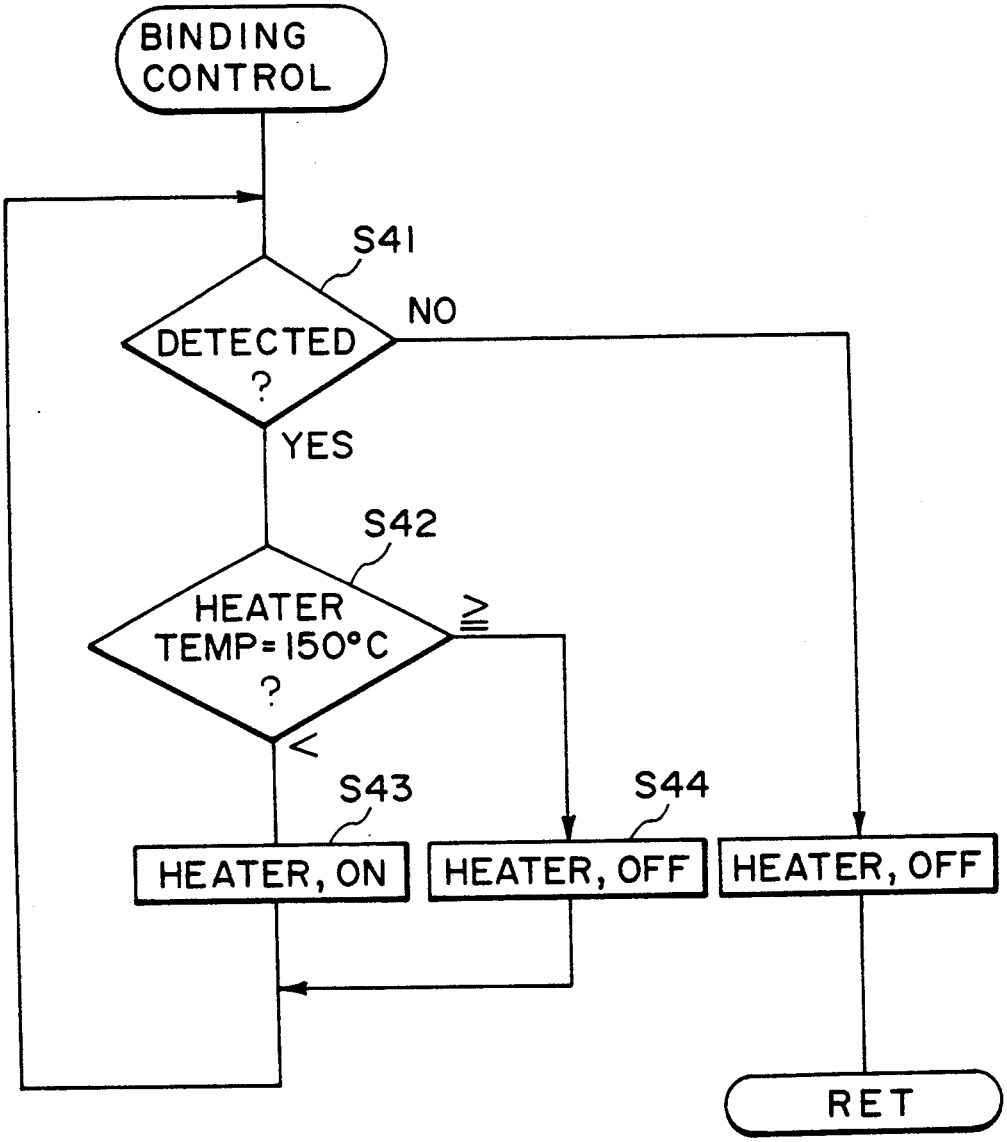
FIG. 8 is a flow chart of a binding operation.

FIG. 8 shows the binding operation control at the step S40. It starts at the reception of the sensor 6 detection signal by the controller 11. Therefore, when the covering material 8 is taken out, the detection signal becomes off. Then, the heater 4 is immediately deenergized, and the operational sequence branches out of the step S40 and to proceed to the pre-heating control (S20) shown in FIGS. 5 and 7.

When the detection signal of the sensor 6 is supplied to the controller 11 at step S41, the heater 4 is actuated (S43) if the temperature is discriminated at step S42 as being lower than 150° C., which is the temperature at which the adhesive agent 9 is melted to permit the binding operation, in this embodiment. When the temperature of the heater 4 is at 150° C. or higher, the heater 4 is deenergized (S44). These operations are continuously repeated. Then, the adhesive agent 9 is melted to permit the binding between the covering material 8 and the sheets 10.

Figure 9:
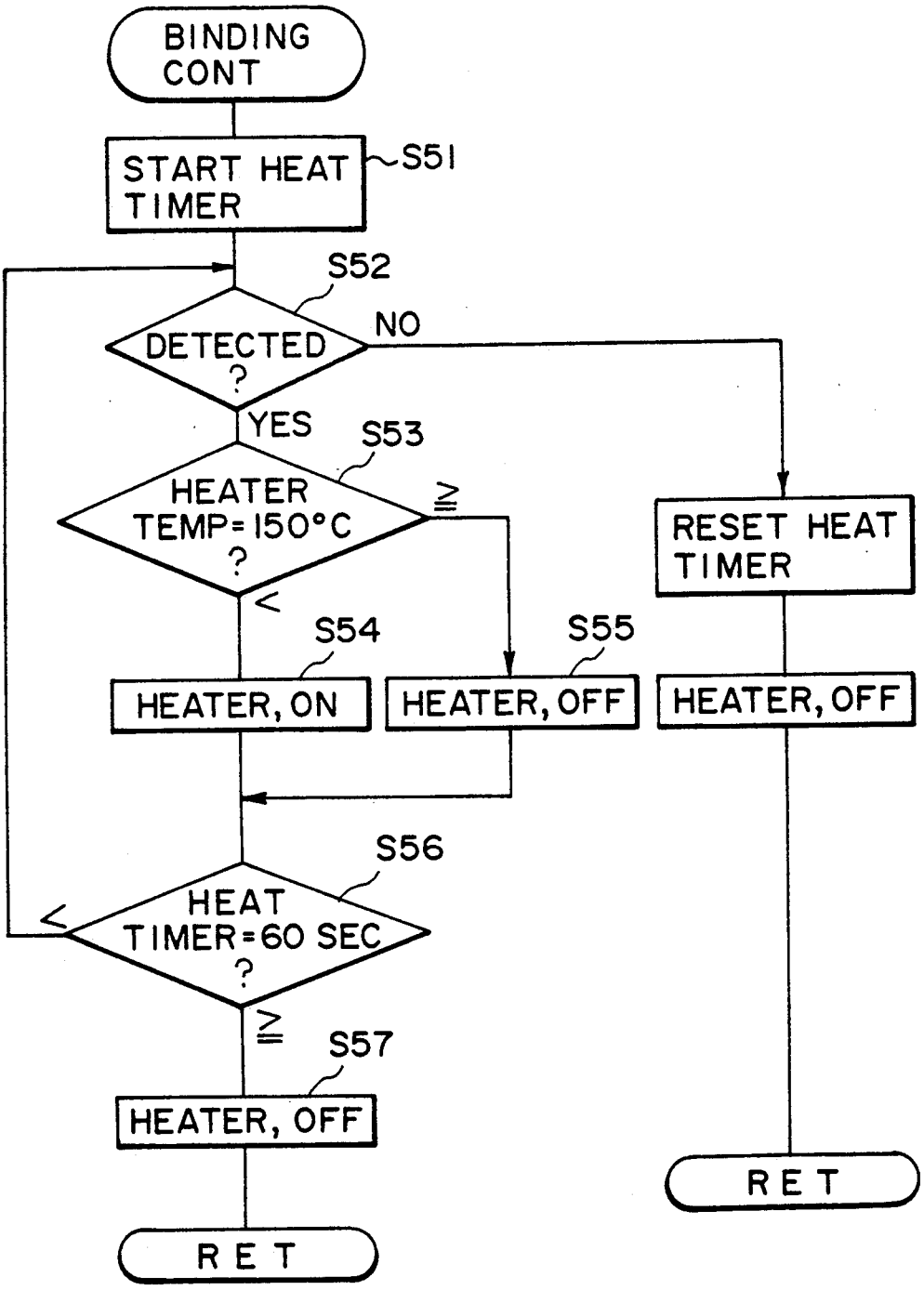
FIG. 9 is a flow chart of a binding operation of the apparatus according to another embodiment of the present invention.

Referring to FIG. 9, another example of the temperature control will be described. In the temperature control of this example, the timing at which the pre-heating operation is started is different from that in the FIG. 8 example.

The initial control (S10), the pre-heating control (S20) and the control (S30) in response to the detection signal are the same as in the foregoing example, and therefore, the detailed description thereof is omitted.

When the detection signal is supplied to the controller 11 (S30) in this example, a heat timer of the controller 11 is started (S51). If the detection signal continues, the operation is performed to maintain the temperature 150° C. of the heater 4 by the steps S53, S54 and S55. Assuming that the time period necessary to let it fuse the adhesive bonding agent 9 and to soak into the set of sheet materials is 60 sec., the binding operation is accomplished when the time counted by the heat timer exceeds 60 sec. (S56). Therefore, the heater is deenergized (S57), and the above-described step S20 is executed (FIGS. 5 and 7).

When the detection signal of the sensor 6 disappears by the covering material 8 being taken out from the holding means 3 at step S52, the heat timer is reset upon which the heater 4 is deenergized, and the sequence goes to the step S20 (FIGS. 5 and 7).

The adhesive agent 9 used in this embodiment is sufficiently melted and sufficiently soaked into the set of sheet materials if it is heated to 150° C. for 60 sec. in this embodiment. Therefore, further heating is wasteful. Therefore, the power consumption and the safety of the apparatus 1 are improved.

Figure 10:
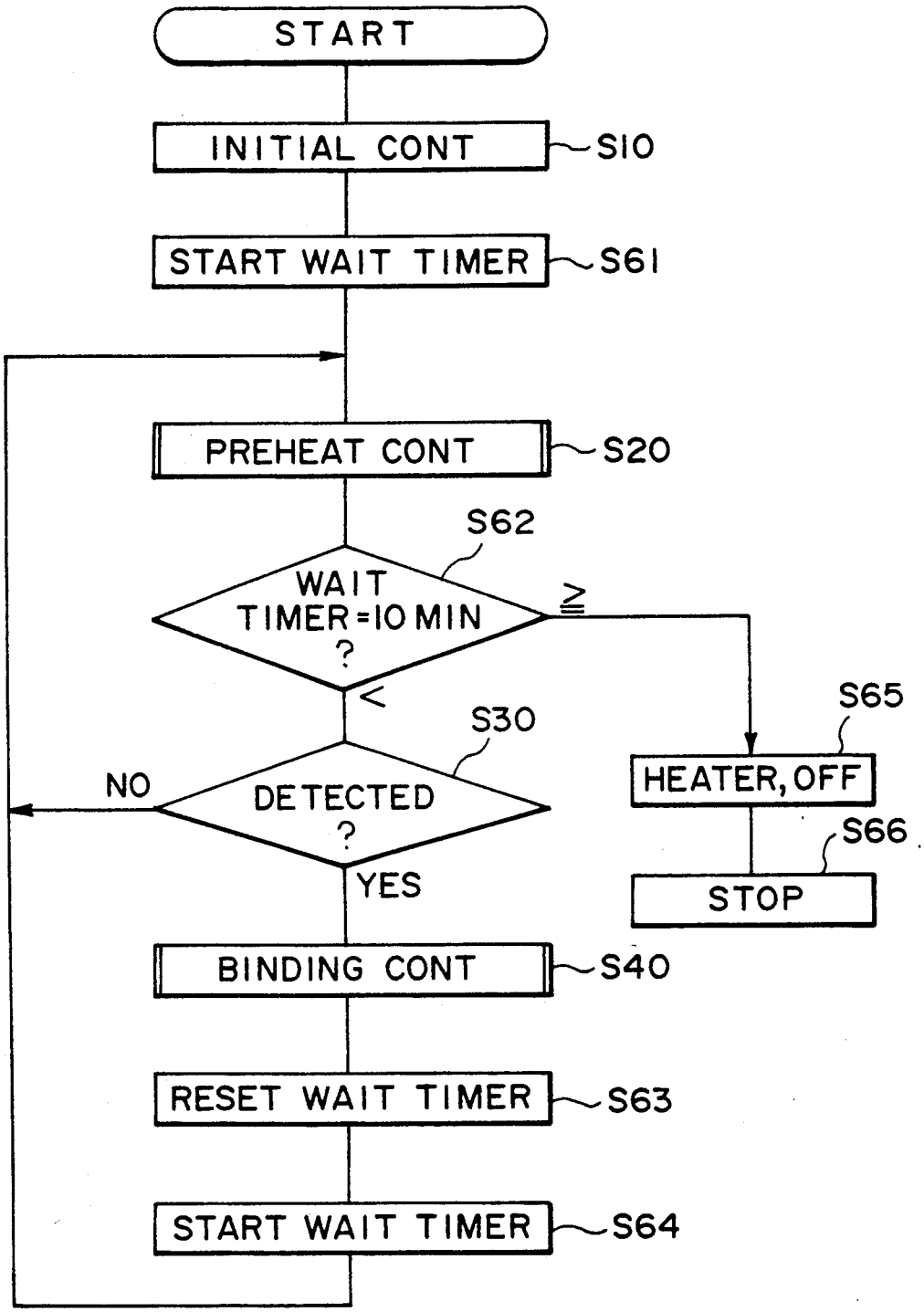
FIG. 10 is a general flow chart of the temperature control operation in an apparatus according to a further embodiment of the present invention.

Referring to FIG. 10, another example of the temperature control will be described.

In this embodiment, the initial control (S10) (FIG. 6) is performed after the main switch is actuated. Thereafter, a timer in the controller 11 is started to count the time period until the sensor 6 detects the covering material 8. Then, the pre-heating control (S20) (FIG. 7) is executed. If the detection signal is received by the controller within the timer period (10 min. in this embodiment) (S62), the binding control (S40) (FIG. 8) is executed. After the binding operation is completed, the timer is reset (S63), and it is re-started (S64) to perform the pre-heating control (S20).

In the step S62, when the covering material 8 is not set in the holding means 3 even after the 10 min. elapse, the temperature control is stopped to deactuate the heater 4 (S65) to interrupt the operation (S66). If the apparatus 1 is to be used again, the main switch is reset.

In this embodiment, when the apparatus 1 is not used for a period of 10 min. or longer, the heater is automatically deenergized, thus prohibiting the wasteful power consumption for the pre-heating operation. Therefore, the power consumption is saved, and the safety of the apparatus is improved.

Figure 11:
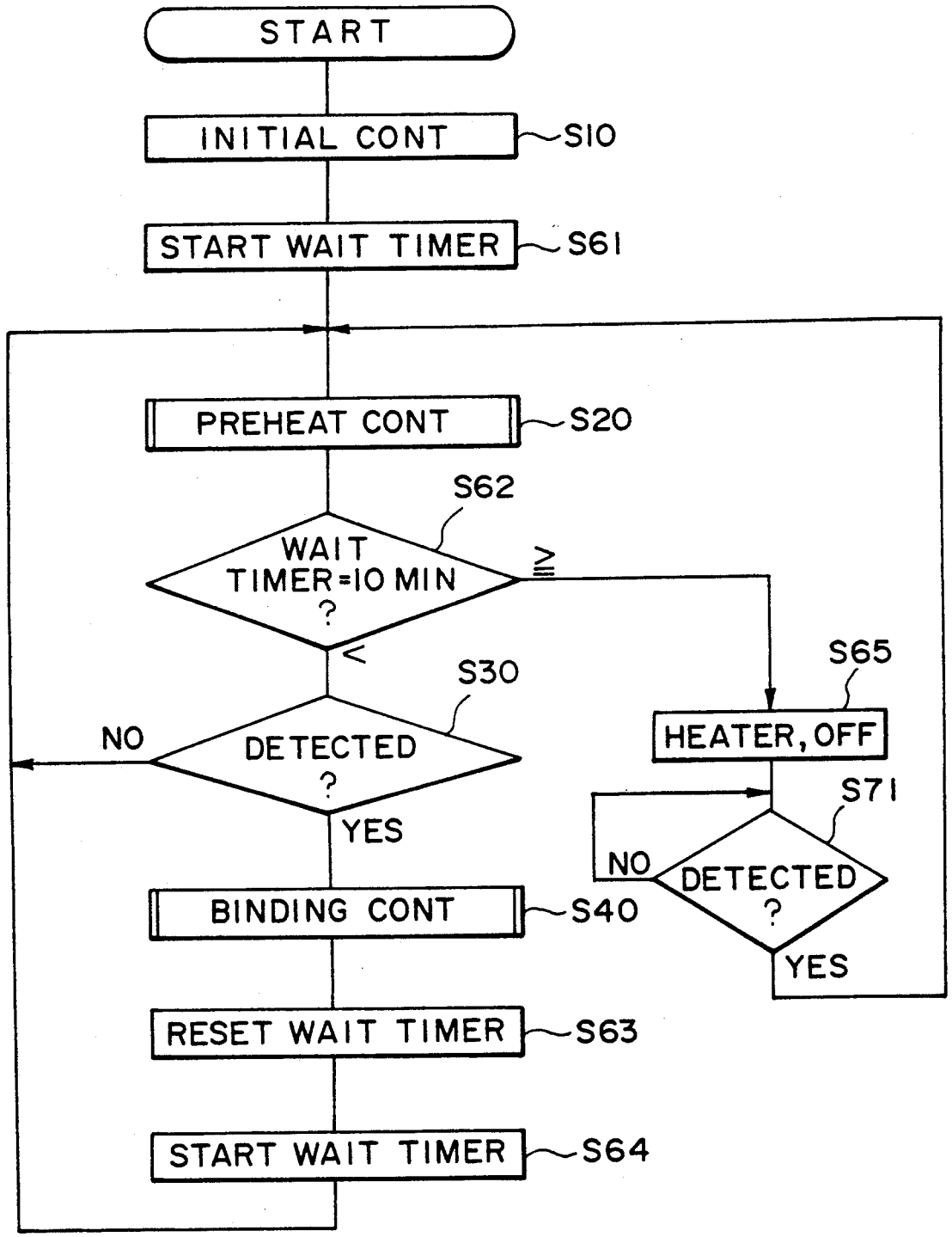
FIG. 11 is a general flow chart according to a further embodiment of the present invention.

Referring to FIG. 11, a further example of the temperature control will be described. In the example of FIG. 10, the heater 4 is kept deenergized (S65). However, in the present embodiment, when the sensor 4 detects the covering material 8, the pre-heating control S20 is executed (S71) in response to the detection signal, and the normal binding operation is performed.

By doing so, when the binding operation is resumed, the operator is not required to reset the main switch.

Figure 12:
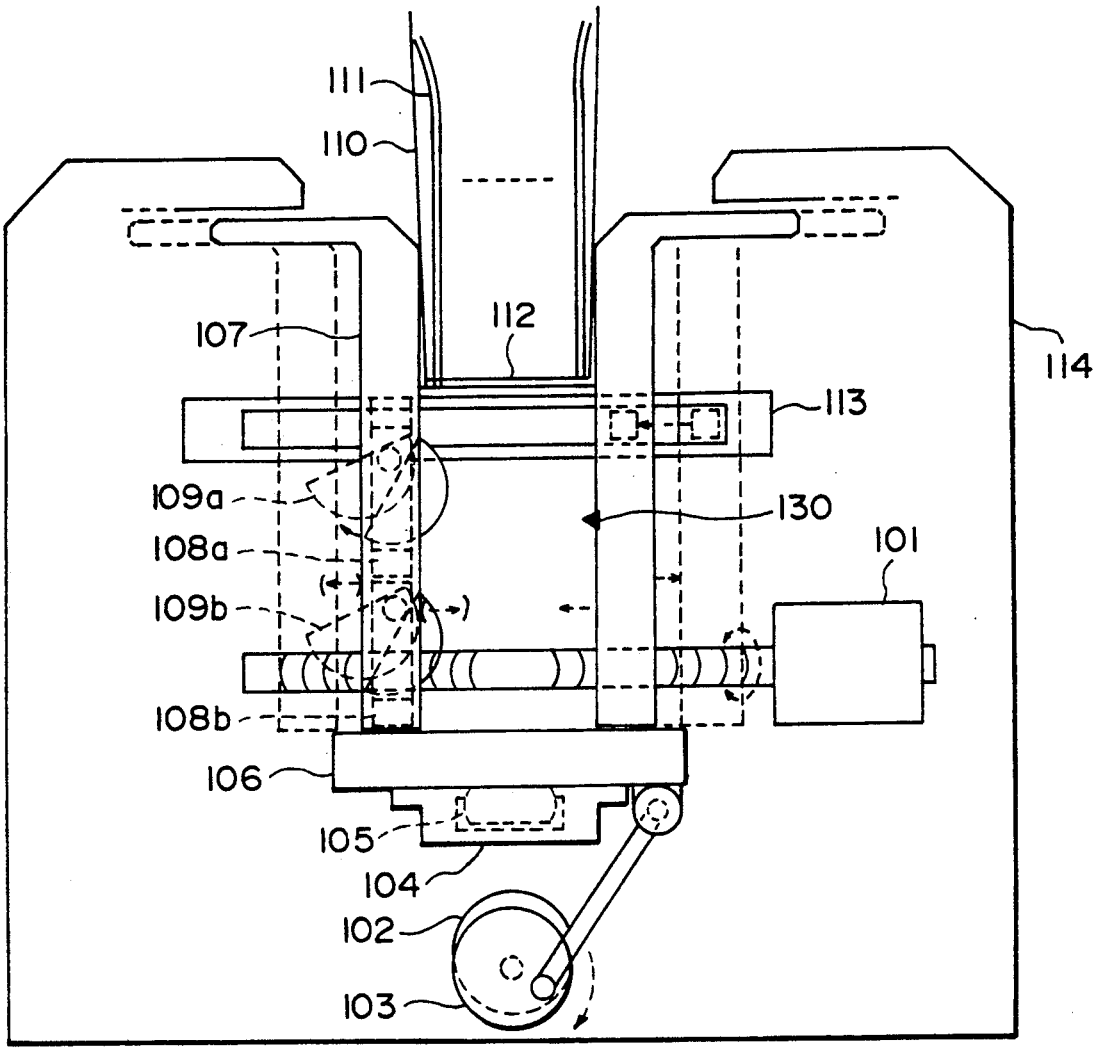
FIG. 12 is a binder apparatus according to a second embodiment of the present invention.

Referring to FIGS. 12–21, a second embodiment of the present invention will be described. In FIG. 12, reference numeral 114 designates a binder; 111, a set of originals to be bound; and 110, a cover with an adhesive agent 112 at the inside of the spine.

When the binding operation is to be performed, an aligned set of original sheets 111 is set between the front cover portion and the back cover portion of the cover 110. Then, they are inserted along a guide 107 already set at its home position to the position where the cover 110 is in contact with a heater 106. The position of the guide 107 is discriminated in accordance with a resistance of an unshown variable resistor associated with the guide 107. The insertion of the set of the originals to the binding position of the binder 114 is detected by interruption of the sheet detecting photointerruptor 108 by a swingable flag 109 or by the transparent type sensor provided at the sides of the guide being interrupted by the set of the originals. In response to the detection signal, a guide shifting motor 1 is rotated in the forward direction, by which one side or both sides of the guide 107 are moved by the gears of the motor shaft. The motor continues to rotate until the guide 7 is stopped by the thickness of the set of originals. Simultaneously, a guide plate contact detection sensor 130 (guide plate contact detection circuit 131 in FIG. 3) is actuated. A determination of the thickness of the set of originals is made in accordance with the change in the resistance of the size detecting variable resistor 113. When the change becomes zero, the guide motor 101 is stopped. By the resistance at this time, the position of the guide 107 is discriminated, and a thickness of the set of the sheet originals is determined.

Thus, the set of the originals are confined by the guide 107, upon which a plurality of the heaters 104 are energized to heat the thermally conductive plate 106 to melt the paste (adhesive agent) 112 on the cover sheet.

In accordance with the thickness determined by the resistance, the energization period t and the heat generating quantity of the heater 104 is determined, and in accordance with the determination, the heaters are energized. During this, the detecting means 105 for detecting the temperature of the heat-conductive member 106, and using the output of the detecting means 5, the heat generation quantity of the heaters 104 is adjusted in accordance with the heat quantity determined above to effect the temperature control.

The heater is swung by a heater swinging motor 102 and a cam 103 to enhance the heat transfer from the heat-conductive member 106 to the cover.

When the paste 112 on the cover 110 is melted and soaked into the set of the sheet originals by the heating for the period t, the power supply to the heater 104 is terminated. Thereafter, the paste 112 is solidified by the spontaneous cooling or the forced cooling using an unshown cooling means such as fan to complete the binding operation.

Figure 13:
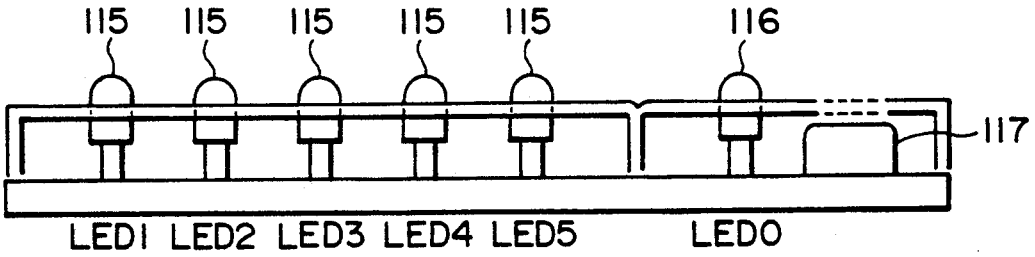
FIG. 13 shows a display portion of the apparatus according to the embodiment.

FIG. 13 is a sectional view of a display portion of the apparatus of this embodiment. It includes an LED (light emitting diode) 116 representing that the power switch is on or that the pre-heating operation is performed, and a warning display 117 for producing a warning or an indication of the completion of the binding operation. It further includes a timer display for displaying progress by changing the light state of the LED in accordance with the energization time t of the heater.

Figure 14:
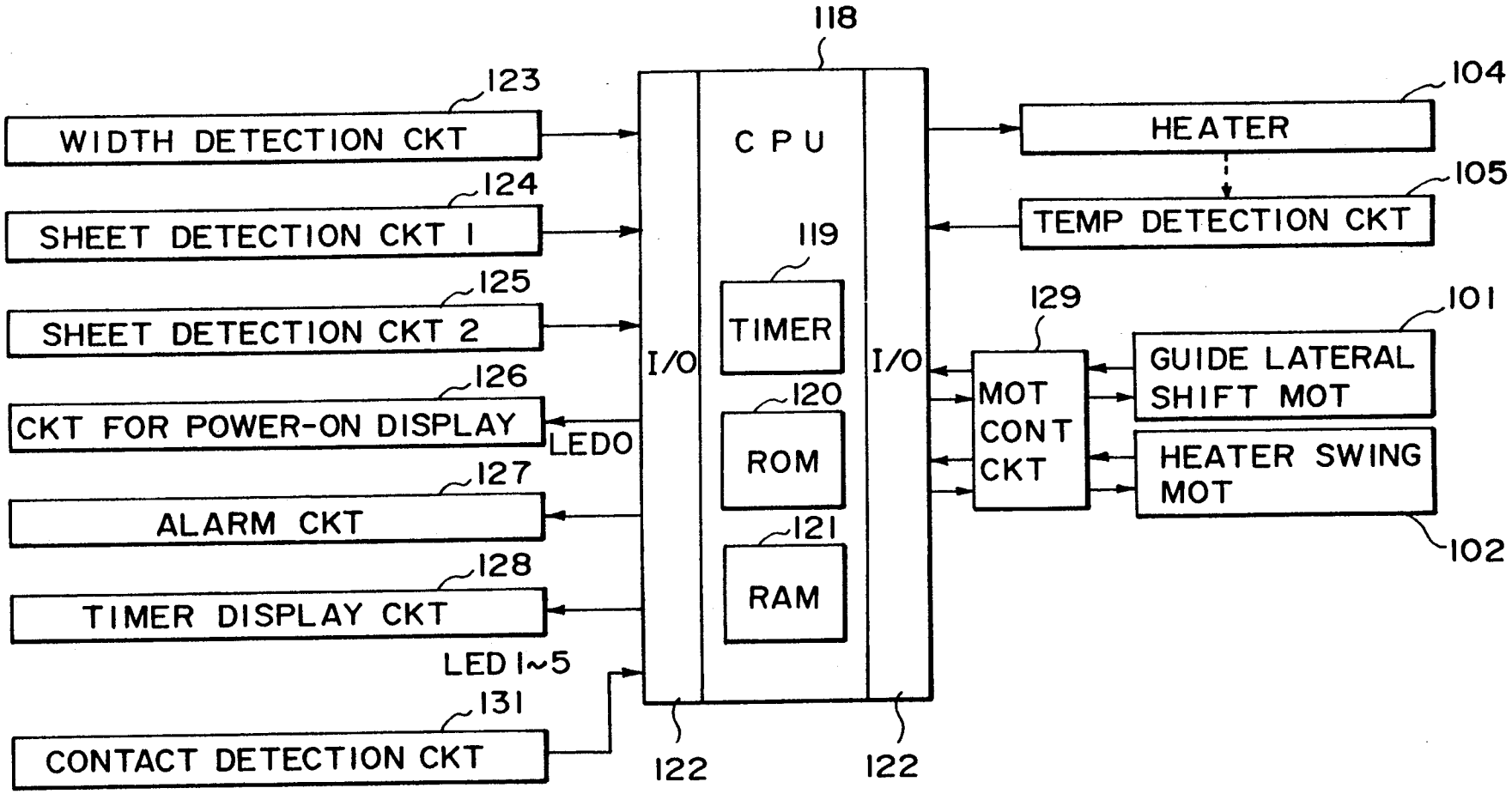
FIG. 14 is a block diagram of a control circuit used in the apparatus of this embodiment.

FIG. 14 is a block diagram of a control circuit used in an apparatus according to an embodiment of the present invention. It includes a CPU (central processing unit) 118, which includes ROM 20 storing the program for the process steps, RAM 21 for the memory of the input data and for the working area, interface I/O 122 for various control signals, and a timer 119.

A size (width) detecting circuit 123 A/D-converts the resistance $V_R$ corresponding to the size, and supplies the converted signal to the CPU.

Sheet detecting circuits 124 and 125 convert an output voltage from the photointerruptor or transparent type sensors 108*a* and 108*b* to binary-coded signals and supplies them to I/O interface.

A power-on display circuit 126 drives the LED 116 shown in FIG. 13 to actuate or deactuate it.

A warning circuit 127 actuates or deactuates a buzzer 117.

A timer display circuit 128 is responsive to an output of the internal timer 119 of the CPU 118 to actuate or deactuate the LED 1-5 and 115. A temperature detecting circuit 105 detects the temperature of the heaters 104, and it A/D-converts the voltage detected by the thermister, for example, and supplies the converted signal to the I/O interface.

A motor control circuit 129 controls the actuation or deactuation of the guide shifting motor 101 and the heater swinging motor 102, the changing of the rotational direction thereof, and the speed thereof. It also detects the current through the motor.

Figure 15:
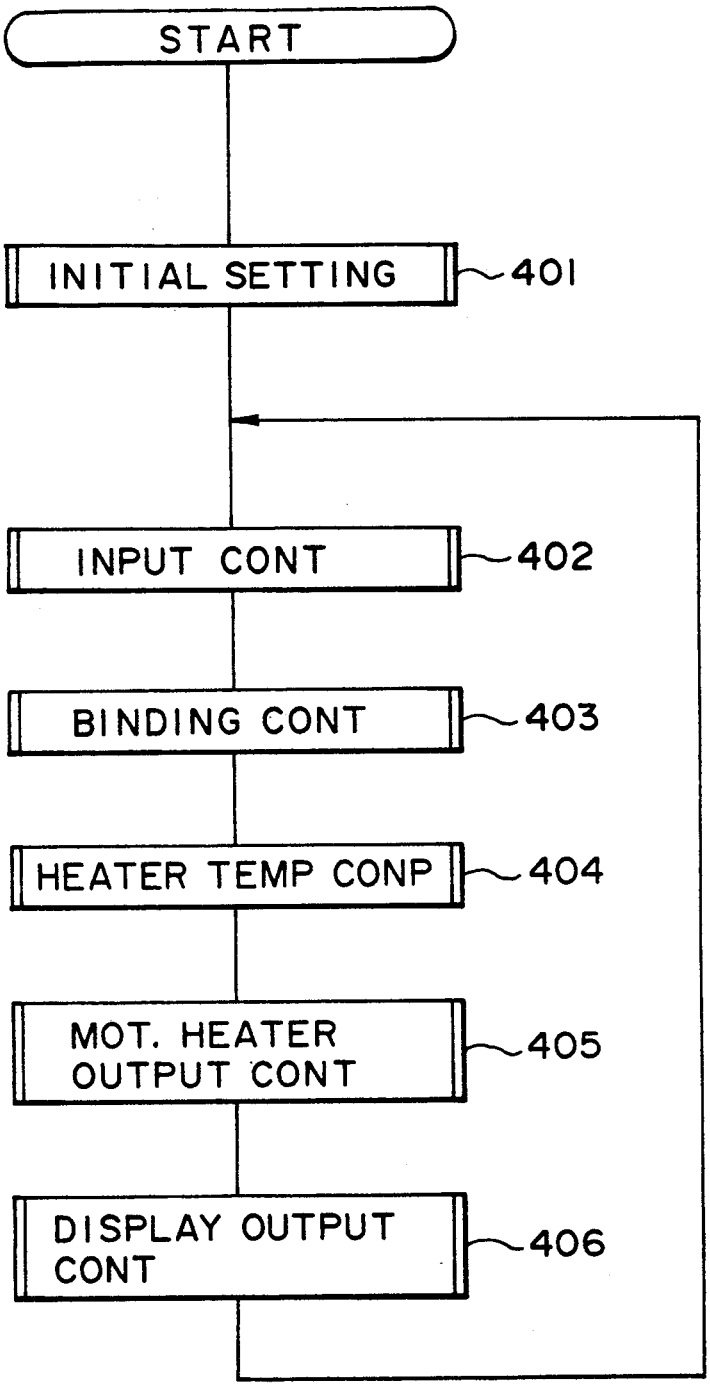
FIG. 15 is a general flow chart of the operation of the apparatus according to this embodiment.

FIGS. 15-21 are flow charts illustrating the operation of the apparatus of this embodiment. FIG. 15 is a general flow chart. FIGS. 16-21 are flow charts for various subroutines.

Referring to FIG. 15, when the CPU 18 starts to operate, various flags are set for the initialization by the initial setting subroutine 401.

In the input control subroutine 402, the flags are set in accordance with the information from various input sensors. In the binding control subroutine 403, the processing in accordance with the binding conditions is performed in accordance with a binding sequence number (BSQ).

In the heater temperature control subroutine 404, the heater is controlled in accordance with the modes.

In the motor and heater output control subroutine 405, the output circuit for the motor and the heater is operated in accordance with the states of the flags of the various motors and heaters.

In the display output control subroutine 406, the output circuit for the display portion is controlled in accordance with the states of the flags relating to the various displays.

When the display output control subroutine 406 is completed, the input control subroutine 402 is performed again, and the operations are repeated.

Figure 16:
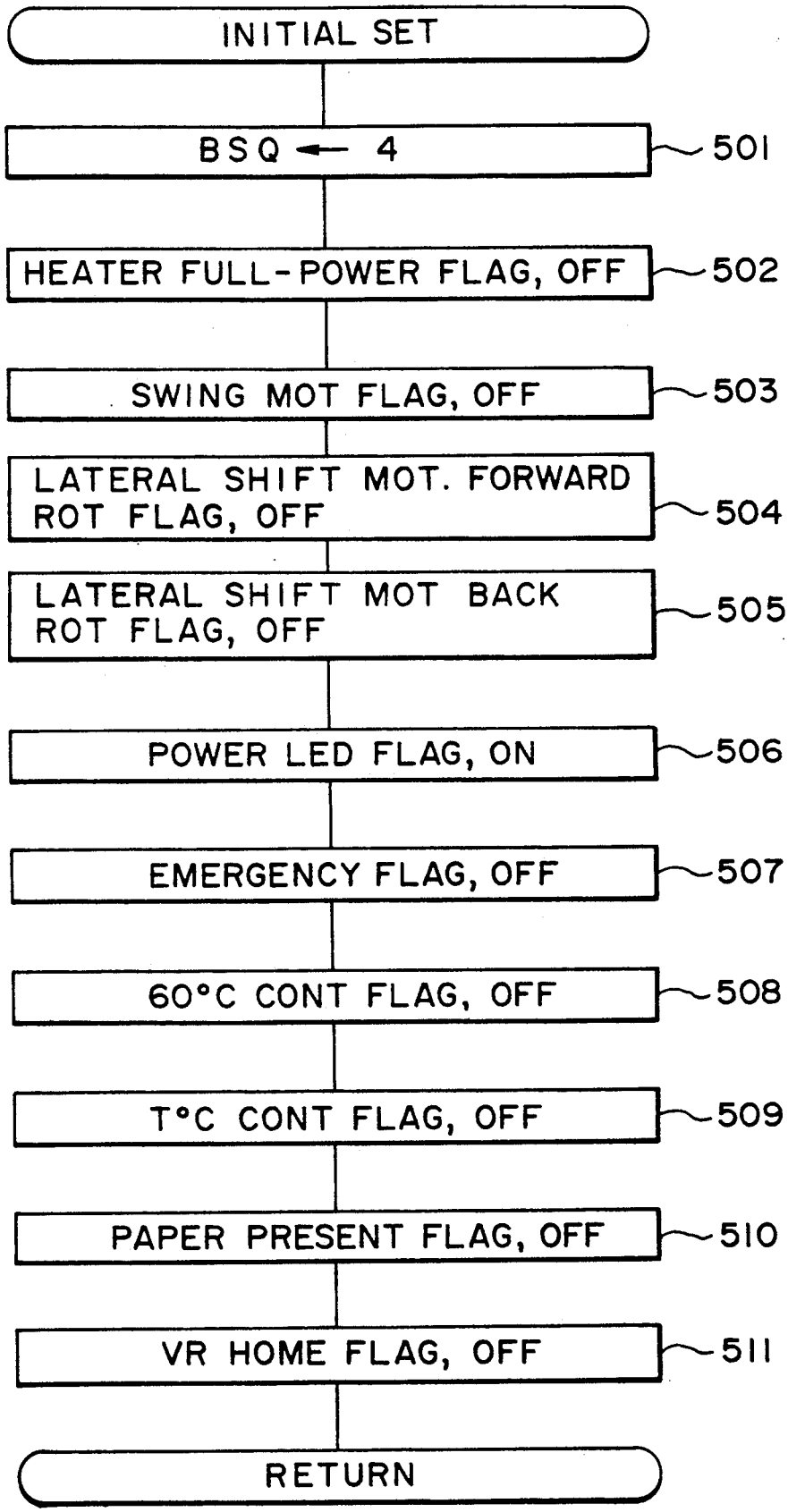
FIG. 16 is a flow chart of an initial setting subroutine in the apparatus of this embodiment.

FIG. 16 is a flow chart of the subroutine for the initial setting.

In FIG. 16, the BSQ is set to 4 at step 501, and the state under which the guide is returned to the home position is set. The BSQ will be described in detail with respect to the binding control subroutine.

At steps 502-511, various flags are set. A heater full power flag is used to discriminate whether the heater is to be kept energized; a swinging motor flag is used to discriminate whether the swinging motor is to be actuated or not; a lateral shifting motor forward flag is used to discriminate whether the shifting motor is to be rotated in the forward direction (guide closing direction); a lateral shifting motor reverse flag is used to discriminate whether the motor is to be rotated in the backward direction (guide opening direction); a power source LED flag is used to discriminate whether the power source LED is to be actuated or not; an emergency flag is used to discriminate whether or not the emergency buzzer is to be actuated or not; a 60° C. temperature control flag is used to discriminate whether the 60° C. keeping temperature control operation (pre-heating temperature control) is to be performed or not; a T° C. temperature control flag is used to discriminate whether the temperature control to keep the high temperature for fusing the paste is to be performed or not; a sheet flag is used to discriminate whether the sheets are set along the guide in accordance with information from the sheet detecting circuits 124 and 125; and VR home position flag is used to discriminate whether the guide is at the home position in accordance with information from the size detection circuit 123.

In the initial setting subroutine, the power source LED flag only is set (ON) at a step 506, and the other flags are reset (OFF).

Figure 17A:
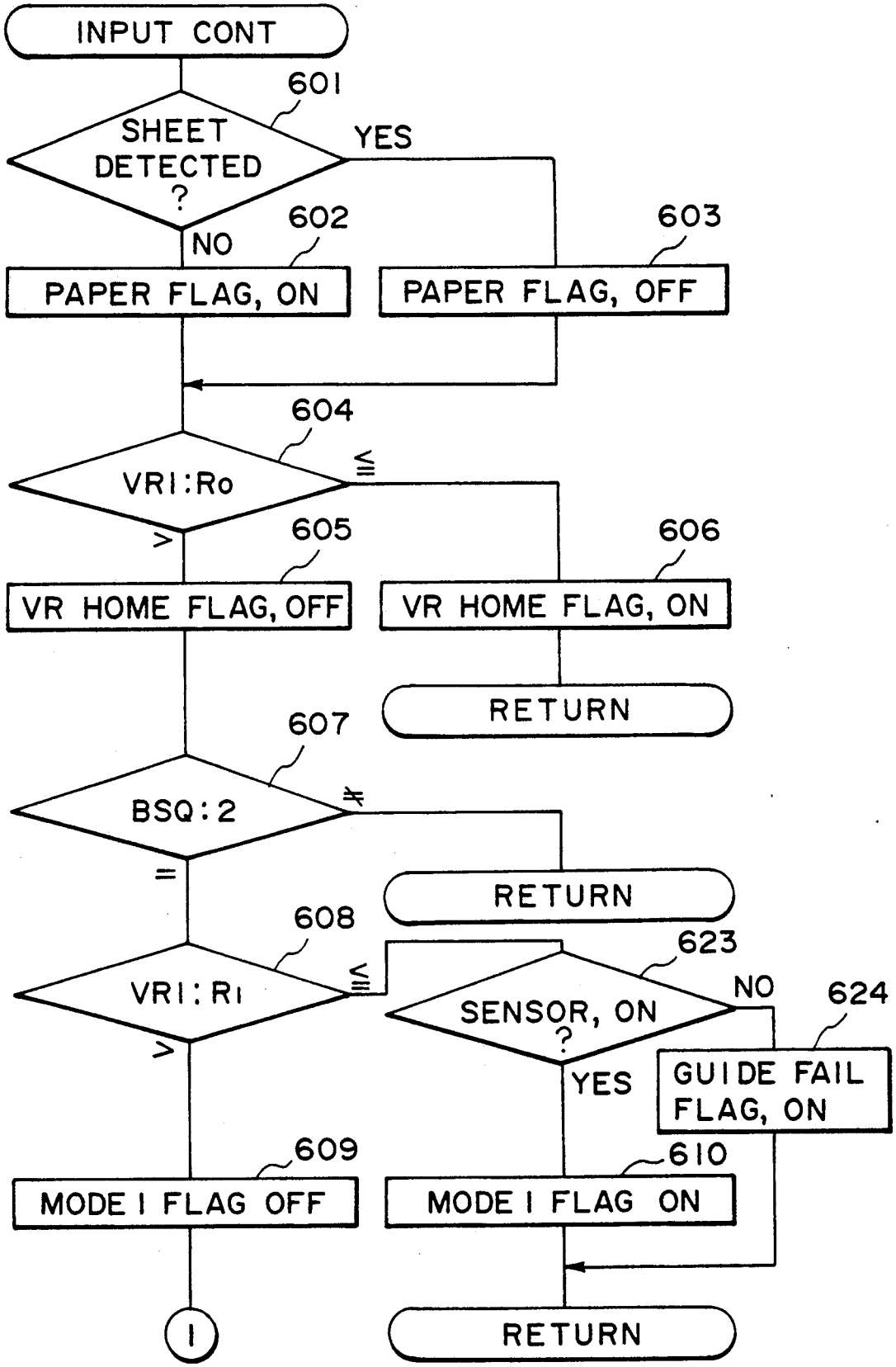
FIGS. 17*a* and *b* show a flow chart of an input control subroutine in the apparatus of this embodiment.
Figure 17B:
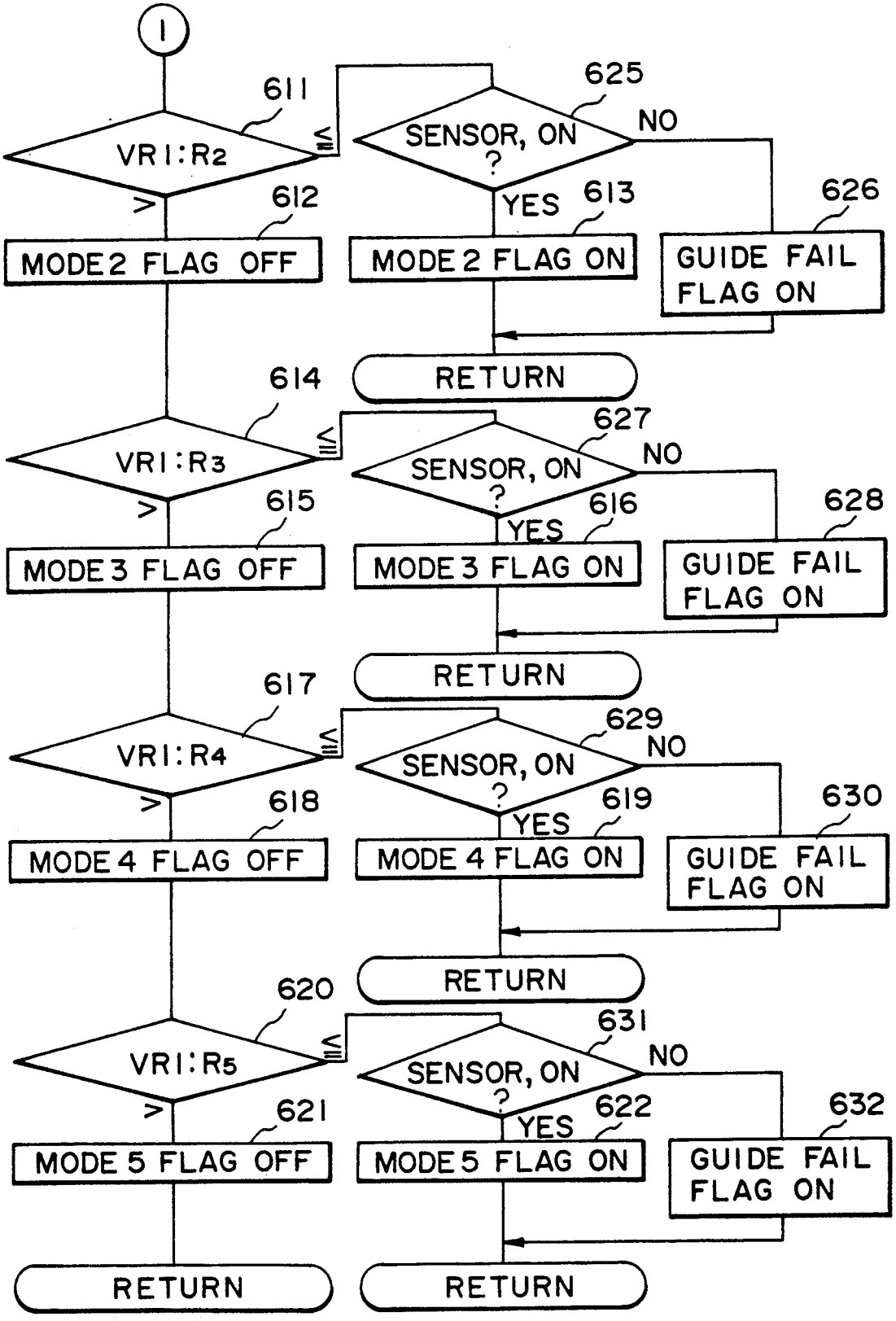

FIG. 17 is a flow chart of an input control subroutine.

When it is discriminated that the sheets are present by the sheet detecting circuits 124 and 125 at step 601, the sheet flag is set. If not, the sheet flag is reset (OFF) at step 603.

Then, at step 604, the comparison is made between a predetermined resistance Ro and the resistance VR1 of the width detecting resistor 113 provided by the size detecting circuit 123. In FIG. 12, the various resistor 113 assumes a low resistance when the knob is at the right position whereas it assumes a high resistance when it is at the left position. Therefore, if the resistance VR1 is not more than the resistance Ro, the rightward deviation is discriminated. Then, at step S606, the VR home position flag is actuated. On the other hand, if the resistance VR1 is larger than the resistance Ro, the out-of-home-position is discriminated, and therefore, the VR home position flag is deactuated at a step 605.

When the out-of-home-position is detected, the discrimination is made at step 607 whether the BSQ is 2 or not. If it is not 2, the data relating to the thickness determined by the variable resistor VR1 is not necessary, and therefore, the input control subroutine is terminated.

If the BSQ is 2, the comparison is made between VR1 and R1, R2, R3, R4 and R5, respectively at steps 608, 611, 614, 617 and 620, respectively. Since $Ro<R1<R2<R3<R4<R5$, the mode is selected from modes 1-5 in accordance with the resistance VR1 to provide data relating to the thickness of the sheets to be bound.

Before the mode is determined in accordance with the VR1 level, the discrimination is made at steps 623, 625, 627, 629 and 631 whether the guide plate contact detecting sensor 130 is actuated or not. If so, the mode is selected from the modes 1-5. If not, that is, if the contact sensor 130 is off despite that the change of the resistance VR1 is zero, the guide failure flag is actuated (ON) at step 624, 626, 628, 630 or 632.

Figure 18:
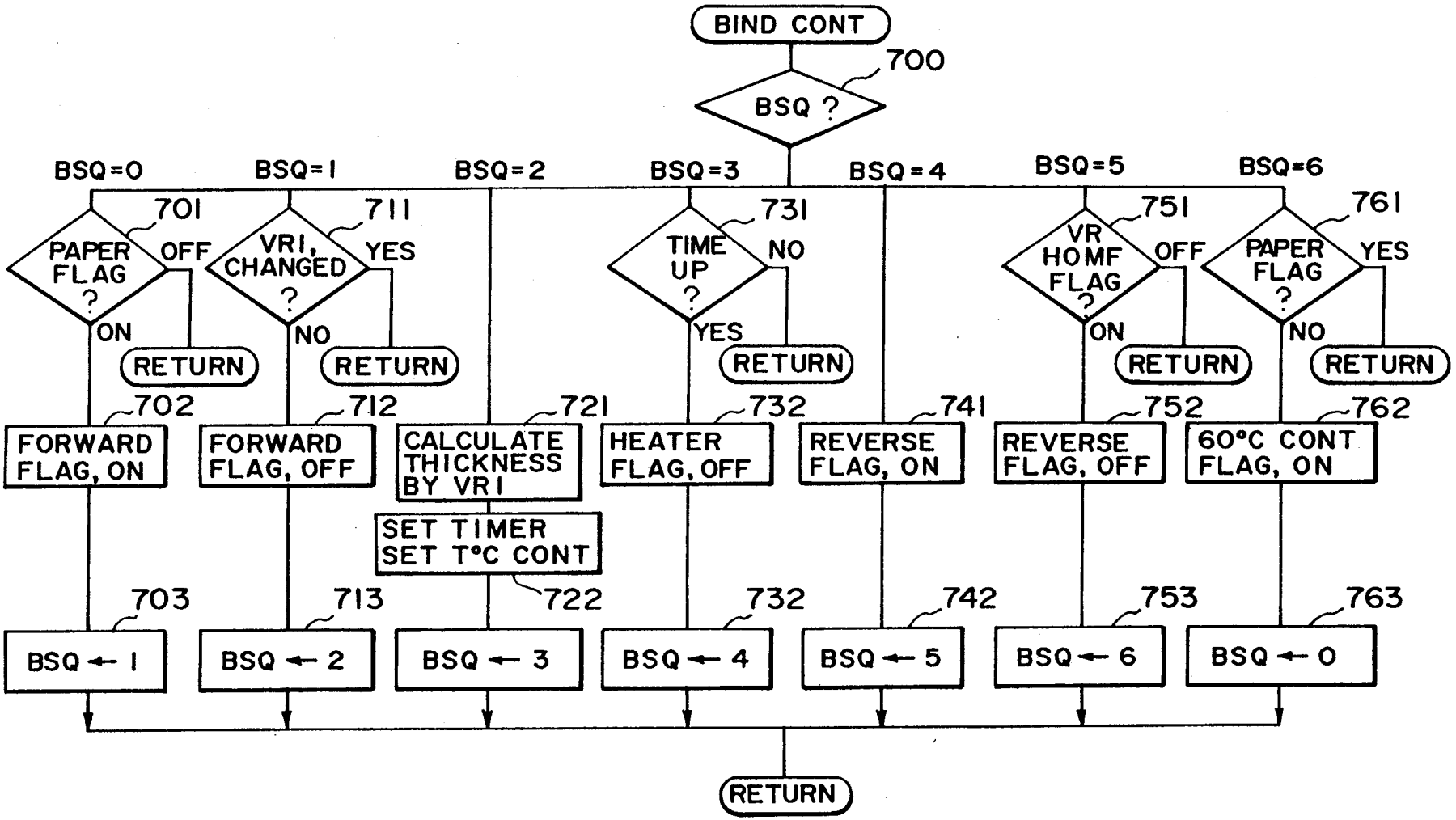
FIG. 18 is a flow chart of a binding control subroutine in this embodiment.

FIG. 18 is a flow chart of a binding control subroutine in this embodiment. In the portion where BSQ=0, the lateral shifting motor is rotated in the forward direction in response to the detection of the set of sheet materials present. In the portion where BSQ=1, the lateral shifting motor is stopped after it is confirmed that the change of the resistance VR1 stops. Where BSQ=2, the temperature control is effected, or the timer is set in accordance with the data (modes 1-5) relating to the thickness determined from VR1. Where BSQ=3, the time-up of the timer is discriminated, and the heater is deenergized. Where BSQ=4, the lateral shifting motor is rotated in the reverse direction. Where BSQ=5, it is confirmed using the VR home position flag that the guide returns to the home position, and the lateral shifting motor is deactuated. Where VR=6, it is confirmed that the set of sheets is taken out from between the guiding plates, and the 60° C. temperature control (pre-heating control) is started. After any of the BSQ portions is performed, it is renewed, and finally the binding control subroutine is completed.

Figures 19, 19B:
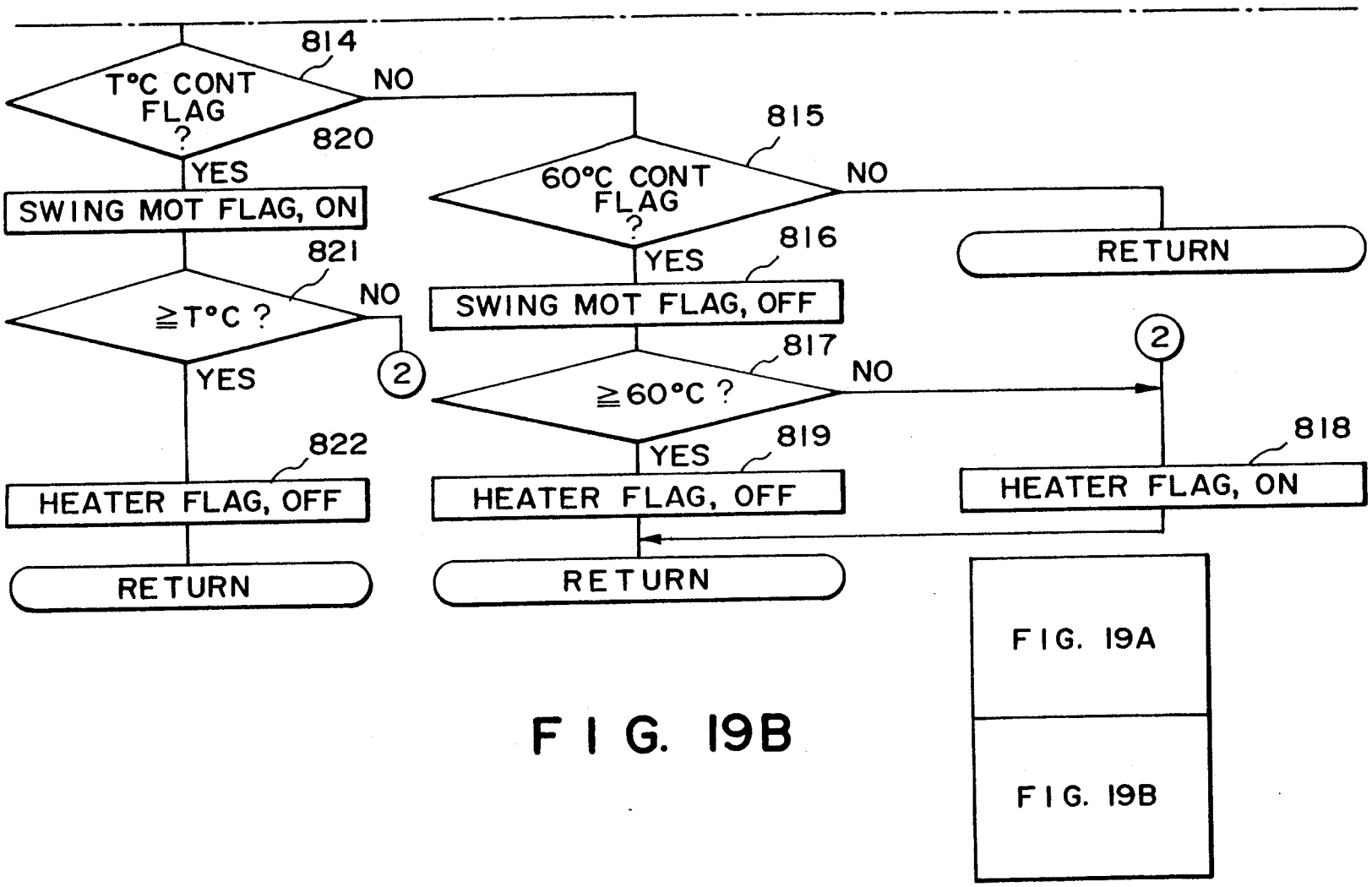
FIGS. 19*a* and *b* show a flow chart of a heater temperature control subroutine in this embodiment.
Figure 19A:
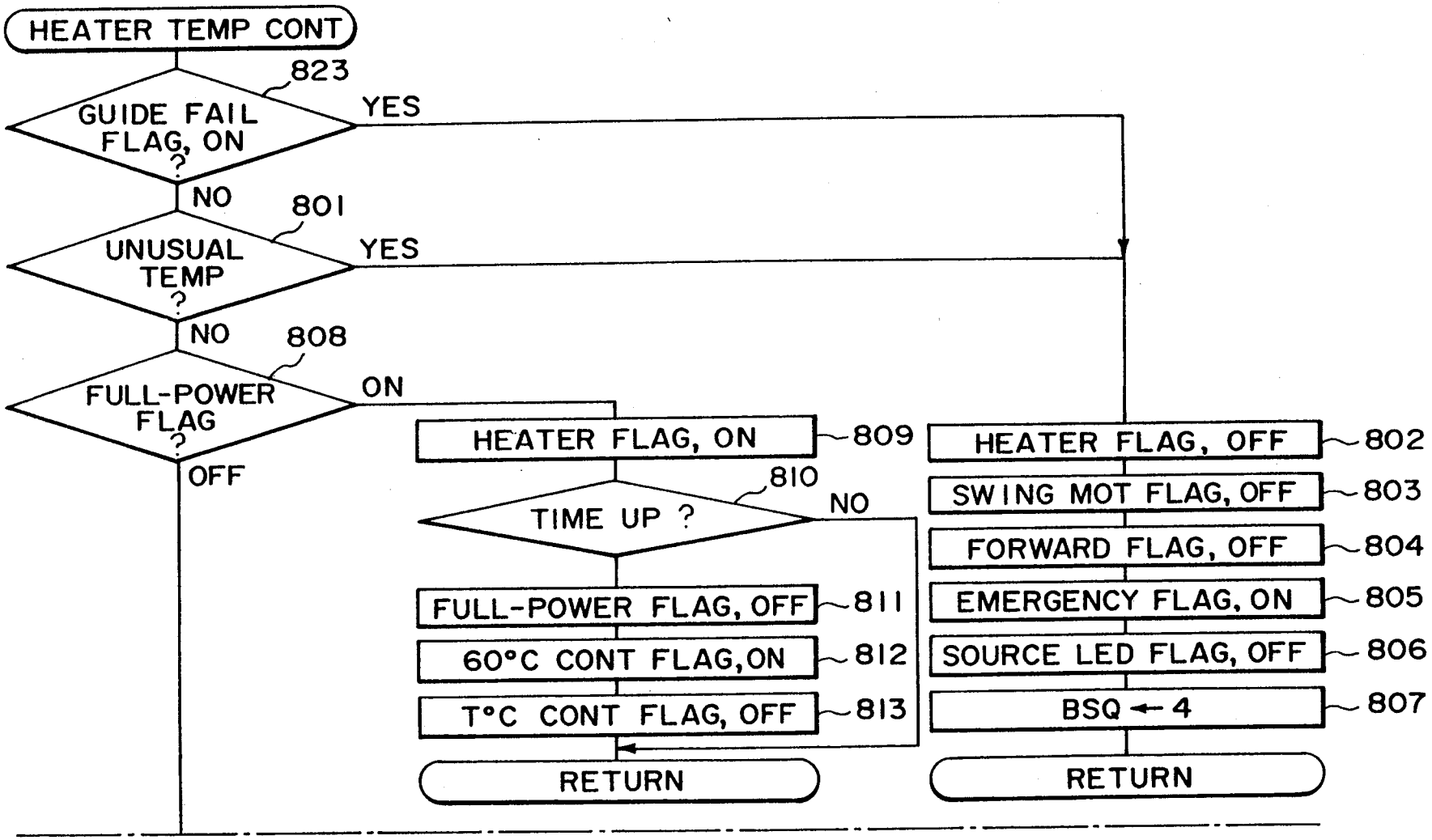

FIG. 19 is a flow chart of the heater temperature control subroutine. At step 823, abnormal state of the guide is checked. If so, a step 801 is executed. If not, the sequence proceeds to step 801. At the step 801, the abnormal temperature of the heater is checked. If it is not normal, all of the heaters, the swinging motor, and the lateral shifting motor LEDs are deenergized, and the emergency flag is set (ON) to actuate the emergency buzzer.

The BSQ is switched to BSQ 4 to rotate the lateral shifting motor in the reverse direction to permit the sheets to be taken out, if any.

If there is no abnormal states, the discrimination is made at step 808 whether the energization of the heater is controlled on the basis of time. If so, the heater is actuated, and the discrimination is made at step 810 as to whether the energization period has elapsed or not. If so, the 60° C. temperature control flag is actuated to pre-heat the apparatus, and the other full power flag and T° C. temperature control flag is deactuated.

The discrimination at step 808 indicates that it is not the energization time control, the discrimination is made at step 814 as to whether the high temperature control is to be effected or not. The temperature at this time is the temperature determined in accordance with the thickness of the set of sheets determined on the basis of the resistance VR1 in BSQ 2 of the binding control subroutine. When, for example, the set of sheet materials has a thickness 1 mm, the heater temperature is set to T° C., and when the thickness is 1′ mm, the heater temperature is T′° C. Here, if $1<1'$, then $T<T'$. If the high temperature control is not performed (815), the discrimination is further made as to whether the low temperature control for the pre-heating is to be effected. If not, the heater is not to be energized, and therefore, the heater temperature control operation is terminated.

When the high temperature control is to be effected (814), the swinging motor is actuated to improve the thermal efficiency relating to the heat from the heater at step 820. Then, the comparison is made to the temperature at the high temperature control at step 821. If it is lower, the heater is energized at step 818, and if it is higher, the heater is deenergized at step 822 to maintain the temperature close to the high temperature control temperature.

When the low temperature control is to be performed at step 815, the swinging motor is deenergized (816) and the temperature is compared with 60° C. at step 817. If it is higher, the heater is deenergized at step 819, and if it is lower the heater is energized at step 818 to maintain a temperature close to 60° C.

Figure 20:
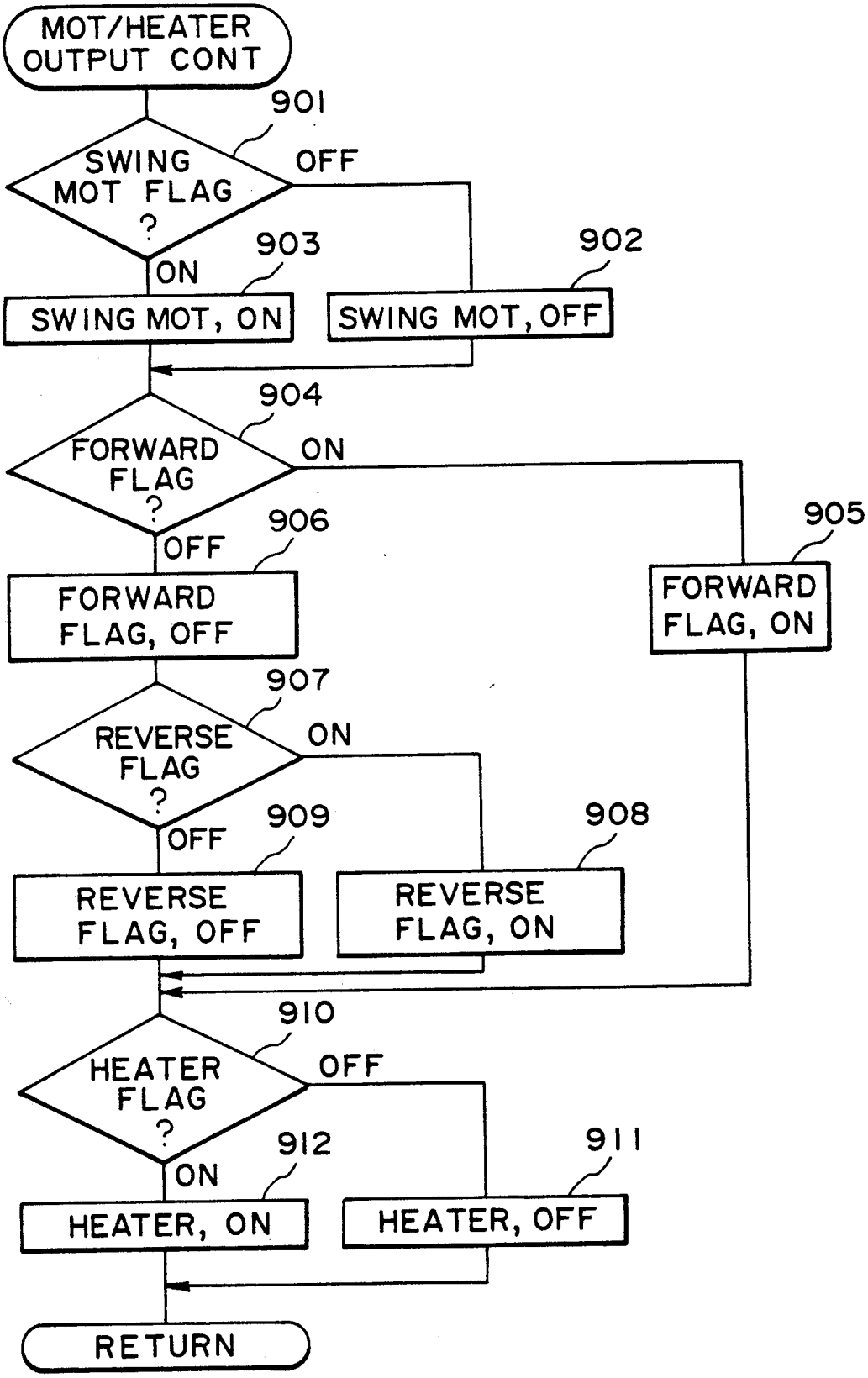
FIG. 20 is a flow chart of a motor and heater output control subroutine in this embodiment.

FIG. 20 is a flow chart of the motor and heater output control subroutine. At steps 901, 904, 907 and 910, the respective flags are checked, and if one or more flags are set (ON), a signal is supplied to the output circuit to drive the motor and the heater. At step 901, the swinging motor flag is discriminated, and if it is OFF, the swinging motor is deactuated at step 902, and the operation proceeds to a step 904. If it is ON, the swinging motor is actuated at step 903, and the operation proceeds to a step 904, where the lateral shifting motor forward flag is discriminated. If the result of discrimination is affirmative, that is, the flag is on, the lateral shifting motor is rotated in the forward direction at step 905, and the operation proceeds to a step 910. If it is off, the forward rotation of the lateral shifting motor is stopped at step 906, and at step 907, the lateral shifting motor reverse flag is discriminated. If it is on, the lateral shifting motor is rotated in the reverse direction at step 908, and the operation proceeds to a step 910. If the results of discrimination is off at the step 907, the reverse rotation of the lateral shifting motor is stopped, and the operation proceeds to a step 910. At this step, the heater flag is discriminated, and if it is OFF, the heater is deenergized at step 911, and if it is ON, the heater is energized at step 912.

Figure 21:
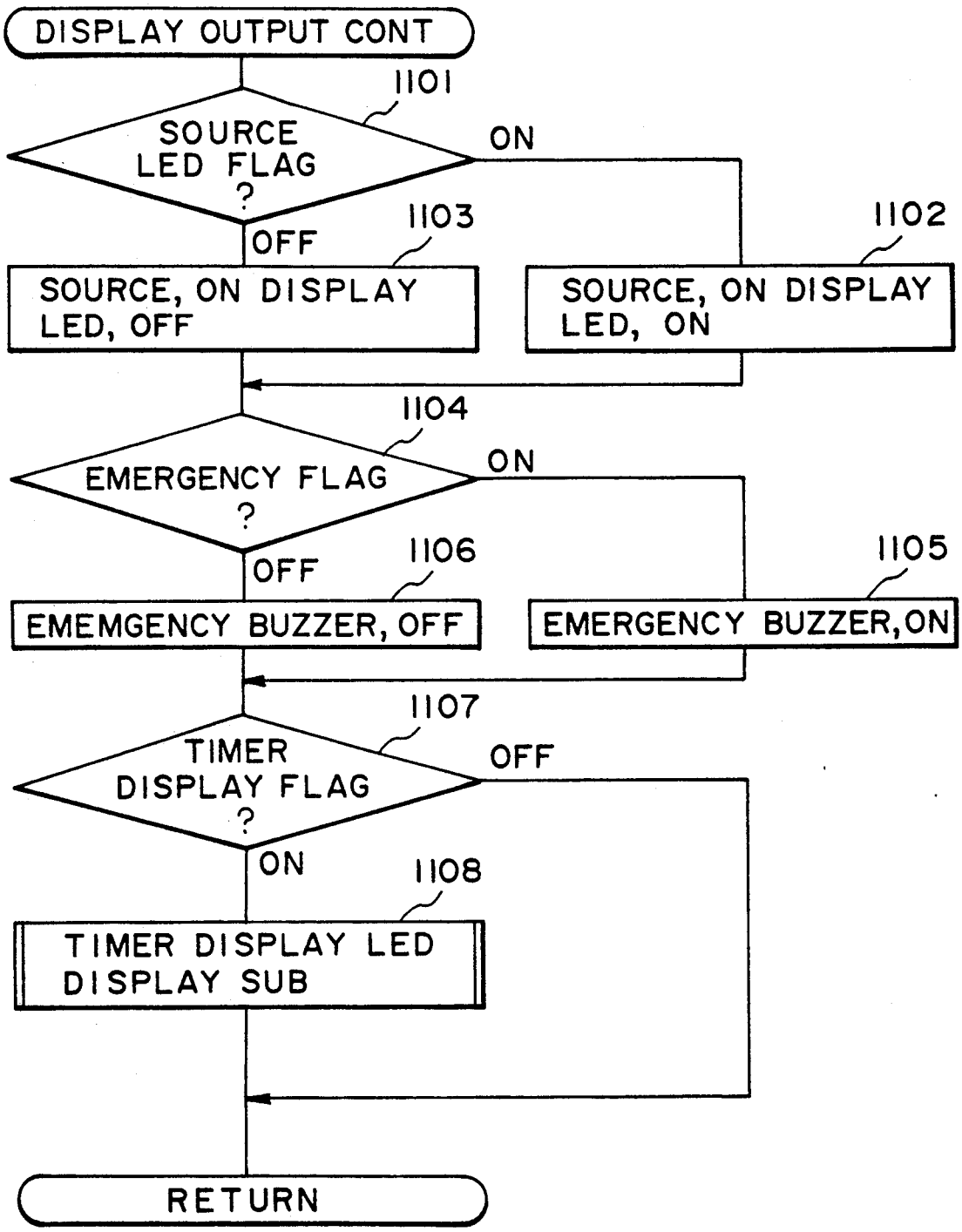
FIG. 21 is a flow chart of a display output control subroutine.

FIG. 21 is a flow chart of a display output subroutine. At steps 1101, 1104 and 1107, the flags are checked, and if the result of check is affirmative (ON), the power-on display LED, the buzzer and the timer display LED are actuated (steps 1102, 1105 and 1108), and if it is negative (OFF), the LEDs and the buzzer are deactuated (steps 1103 and 1106).

As described in the foregoing, according to this embodiment, the thickness of the set of the sheet materials is detected, and the heater temperature can been controlled in accordance with the thickness detected.

Figure 22:
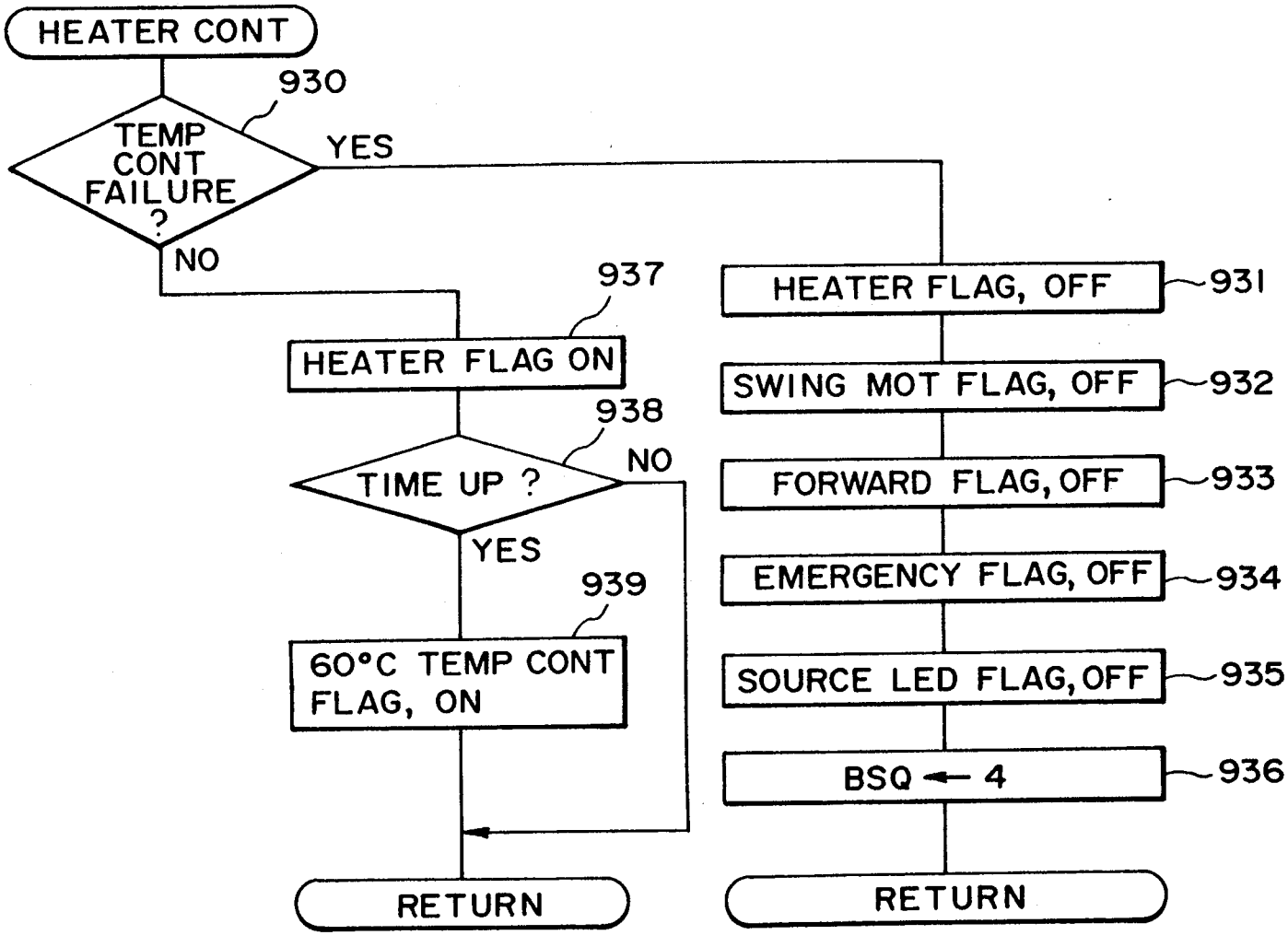
FIG. 22 is a flow chart according to another example of the heater temperature control subroutine usable in the second embodiment of the present invention.

FIG. 22 shows another example of the temperature control in the second embodiment. In the embodiments of FIGS. 12–21, the thickness of the materials to be bound is detected, and the temperature of the paste fusing heater is controlled. In the present embodiment (FIG. 22), the energization period of the heater is controlled.

FIG. 22 is a flow chart of the heater temperature control operation. At step 930, the unusual temperature of the heater is checked. If it is unusual, the heater, the swinging motor, the lateral shifting motor and the power source LED are all rendered OFF. In addition, an emergency flag is actuated (ON) (steps 931–935) to actuate the warning buzzer, and at step 936, the BSQ is switched to BSQ 4 to rotate the lateral shifting motor in the reverse direction to permit the sheets to be taken out, if any.

If no unusual state is detected at step 930, the heater is driven with full power, and the discrimination is made at step 938 as to whether the energizing period elapses or not. The energizing period is determined from the thickness of the set of sheet materials obtained from the resistance VR1 in the BSQ 2 in the binding control subroutine of FIG. 18. When the thickness of the set of sheet materials is 1 mm, the heater energizing period is t sec; and when the set of sheet materials has a thickness 1′ mm, the heater energizing period is t′ sec. Here, if $1<1'$, then $t<t'$. If it is discriminated at step 938 that the energizing period has elapsed, the 60° C. temperature control flag is actuated to perform the preliminary heating, and the operation returns. The other operations are the same as in the foregoing embodiment.

As described in the foregoing, according to this embodiment of the invention, the thickness of the sheets to be bound is detected, and the energizing period of the heater can be controlled in accordance with the thickness detected.

According to the embodiment described in conjunction with FIGS. 12–22, the thickness of the materials to be bound are detected, and the paste fusing heater is controlled in accordance with the thickness detected, and therefore, the paste can be sufficiently melted irrespective of the thickness of the materials to be bound.

By controlling the energizing period for the heater, the binding operation period can be reduced as compared with the conventional apparatus, when the thickness of the cover is small. By providing means for detecting that the guide plate and the materials to be bound are contacted in connection with the means for detecting the width (thickness) of the materials to be bound in accordance with movement distance of the guiding plate, it becomes possible whether the guiding plate stops without error or stopped by foreign matters introduced into the apparatus, and therefore, the binding operation can be performed in good order. In addition, it becomes possible to stop the power supply to the load or loads upon occurrence of an unusual state, and therefore, the safety can be further improved.

While the invention has been described with reference to the structures disclosed herein, it is not confined to the details set forth and this application is intended to cover such modifications or changes as may come within the purposes of the improvements or the scope of the following claims.

What is claimed is:

1. A binding apparatus for binding sheet materials with a covering material having a heat-adhesive agent at its bottom portion by bonding the bottom portion of the covering material and edges of the sheet materials, comprising:

holding means for holding the covering material and the sheet materials sandwiched between the covering material;

heating means for heating the adhesive agent;

detecting means for detecting setting of the covering material in said holding means;

temperature detecting means for detecting the temperature of said heating means; and temperature control means for supplying, when a main switch is actuated without the covering material set in said holding means, power to said heating means if an output of said temperature detecting means indicates a temperature lower than a first predetermined temperature to heat said heating means to the first predetermined temperature, and for prohibiting the supply of power to said heating means when the output of said temperature detecting means indicates a temperature higher than the first predetermined temperature, said control means also supplying power to said heating means to provide a second temperature higher than the first temperature when the covering material is set in said holding means, and for supplying power to said heating means to provide the first temperature after the covering member is taken out from said holding means.

2. An apparatus according to claim 1, wherein the first temperature is selected so as to completely melt the agent, and wherein the second temperature is set to be a temperature high enough to sufficiently melt the agent to enable a binding operation of said apparatus.

3. An apparatus according to claim 2, wherein the first temperature is not higher than substantially 70° C.

4. An apparatus according to claim 2, wherein said control means stops its temperature control and stops the power supply to said heating means when a detection signal by said setting detecting means is not produced within a predetermined period.

5. An apparatus according to claim 4, wherein when the detection signal is produced after the stoppage of the temperature control and the power supply to said heating means, said control means permits the heating operation and the temperature control operation to be resumed.

6. A binding apparatus for binding sheet materials with a covering material having a heat-adhesive agent at its bottom portion by bonding the bottom portion of the covering material and edges of the sheet materials, comprising:

holding means for holding the covering material and the sheet materials sandwiched between the covering material;

heating means for heating the adhesive agent;

detecting means for detecting setting of the covering material in said holding means;

temperature detecting means for detecting the temperature of said heating means; and temperature control means for supplying, when a main switch is actuated without the covering material set in said holding means, power to said heating means if an output of said temperature detecting means indicates a temperature lower than a first predetermined temperature to heat said heating means to the first predetermined temperature, and for prohibiting the supply of power to said heating means when the output of said temperature detecting means indicates a temperature higher than the first predetermined temperature, said control means also supplying power to said heating means to provide a second temperature higher than the first temperature when the covering material is set in said holding means.

7. An apparatus according to claim 6, wherein the first temperature is selected so as not to completely melt the agent, and wherein the second temperature is set to be a temperature high enough to sufficiently melt the agent to enable a binding operation of said apparatus.

8. An apparatus according to claim 7, wherein the first temperature is not higher than substantially 70° C.

9. An apparatus according to claim 7, wherein said control means stops its temperature control and stops the power supply to said heating means when a detection signal by said setting detecting means is not produced within a predetermined period.

10. An apparatus according to claim 9, wherein when the detection signal is produced after the stoppage of the temperature control and the power supply to said heating means, said control means permits the heating operation and the temperature control operation to be resumed.

11. An apparatus according to claim 6, wherein said temperature control means operates to provide the first temperature when the temperature detecting means detects an agent melting temperature.

12. An apparatus according to claim 6, wherein said temperature control means includes a timer, and when a predetermined period of time elapses after start of the heating to provide the second temperature, then said temperature control means operates to provide the first temperature.

13. A binding apparatus for binding sheet materials with a covering material having a heat-adhesive agent at its bottom portion by bonding the bottom portion of the covering material and edges of the sheet materials, comprising:

holding means for holding the covering material and the sheet materials sandwiched between the covering material;

heating means for heating the adhesive agent;

detecting means for detecting setting of the covering material in said holding means;

temperature detecting means for detecting the temperature of said heating means; and temperature control means for supplying, when a main switch is actuated without the covering material set in said holding means, power to said heating means if an output of said temperature detecting means indicates a temperature lower than a first predetermined temperature to heat said heating means to the first predetermined temperature, and for prohibiting the supply of power to said heating means when the output of said temperature detecting means indicates a temperature higher than the first predetermined temperature, said control means also supplying power to said heating means to provide a second temperature higher than the first temperature when the covering material is set in said holding means, and for shutting off the power supply when the first temperature continues for a predetermined period of time.

14. An apparatus according to claim 13, wherein when said detecting means detects setting of the covering material in said holding means, said temperature control means controls the power supply to provide the second temperature.

15. A binding apparatus for binding sheet materials with a covering material having a heat-adhesive agent at its bottom portion by bonding the bottom portion of the covering material and edges of the sheet materials, comprising:

holding means for holding the covering material and the sheet materials sandwiched between the covering material;

heating means for heating the adhesive agent;

detecting means for detecting setting of the covering material in said holding means; and power supply control means for supplying power to said heating means to provide a first temperature when the covering material is not set in said holding means, for supplying power to said heating means to provide a second temperature higher than the first temperature when the covering material is set in said holding means, for shutting off the power supply when the first temperature continues for a predetermined period of time, and when said detecting means detects the covering material after the power supply is shut off, said control means supplies power to said heating means to heat the adhesive agent to the second temperature.

16. A binding apparatus for binding sheet materials with a covering material having a heat-adhesive agent at its bottom portion by bonding the bottom portion of the covering material and edges of the sheet materials, comprising:

holding means for holding the covering material and the sheet materials sandwiched between the covering material;

heating means for heating the adhesive agent;

detecting means for detecting setting of the covering material in said holding means; and power supply control means for supplying power to said heating means to provide a first temperature just above the melting temperature of the adhesive agent when the covering material is not set in said holding means while a main switch of the apparatus is on, and for supplying power to said heating means to provide a second temperature higher than the first temperature when the covering material is set in said holding means.

17. An apparatus according to claim 16, wherein the first temperature is not higher than approximately 70° C.

* * * * *

UNITED STATES PATENT AND TRADEMARK OFFICE

CERTIFICATE OF CORRECTION

PATENT NO. : 5,246,325

DATED : September 21, 1993

INVENTOR(S) : Morishige et al.

It is certified that error appears in the above-indentified patent and that said Letters Patent is hereby corrected as shown below:

Drawings:
SHEET 13:

FIG. 15, "CONP" should read --CONT--.

COLUMN 4:

Line 25, "damaged" should read --injured--.
Line 54, "to proceed" should read --proceeds--.

COLUMN 11:

Line 10, "stopped" should read --is stopped-- and "matters" should read --matter--.
Line 55, "as to" should read --as not to--.

Signed and Sealed this

Nineteenth Day of July, 1994

Bruce Lehman

*Attest:*

BRUCE LEHMAN

*Attesting Officer*

*Commissioner of Patents and Trademarks*